US010665955B2

(12) United States Patent
Hirabe

(10) Patent No.: US 10,665,955 B2
(45) Date of Patent: May 26, 2020

(54) RADIO SIGNAL TRANSMITTING ANTENNA, RADIO SIGNAL RECEIVING ANTENNA, RADIO SIGNAL TRANSMISSION/RECEPTION SYSTEM, RADIO SIGNAL TRANSMITTING METHOD, AND RADIO SIGNAL RECEIVING METHOD

(71) Applicant: NEC Corporation, Minato-ku, Tokyo (JP)

(72) Inventor: Masashi Hirabe, Tokyo (JP)

(73) Assignee: NEC CORPORATION, Tokyo (JP)

( * ) Notice: Subject to any disclaimer, the term of this patent is extended or adjusted under 35 U.S.C. 154(b) by 1 day.

(21) Appl. No.: 15/764,379

(22) PCT Filed: Oct. 1, 2015

(86) PCT No.: PCT/JP2015/005022
§ 371 (c)(1),
(2) Date: Mar. 29, 2018

(87) PCT Pub. No.: WO2017/056136
PCT Pub. Date: Apr. 6, 2017

(65) Prior Publication Data
US 2018/0287263 A1 Oct. 4, 2018

(51) Int. Cl.
*H01Q 19/06* (2006.01)
*H01Q 19/17* (2006.01)
(Continued)

(52) U.S. Cl.
CPC ..... *H01Q 19/17* (2013.01); *H01Q 3/40* (2013.01); *H01Q 15/16* (2013.01); *H01Q 15/22* (2013.01);
(Continued)

(58) Field of Classification Search
CPC ..... H01Q 19/17; H01Q 19/06; H01Q 19/19; H01Q 19/062; H01Q 15/22; H01Q 15/16; H01Q 25/04; H01Q 21/20; H01Q 3/40
See application file for complete search history.

(56) References Cited

U.S. PATENT DOCUMENTS

2013/0265197 A1* 10/2013 Jones ..... H01Q 1/246 342/373
2015/0029070 A1 1/2015 Ohshima et al.
(Continued)

FOREIGN PATENT DOCUMENTS

JP 2015-027042 A 2/2015
WO 2005/069443 A1 7/2005
(Continued)

OTHER PUBLICATIONS

Extended European Search Report for EP Application No. EP15905291.9 dated Jul. 27, 2018.
(Continued)

*Primary Examiner* — Hoang V Nguyen
*Assistant Examiner* — Awat M Salih

(57) ABSTRACT

The present invention is a radio signal transmitting antenna (10) including a first wave source (11) including a plurality of antenna elements (A1 to AN) configured to form a first helical beam (H) for OAM (Orbital Angular Momentum) from the plurality of antenna elements (A1 to AN) and output the first helical beam (H) and a second wave source (15) configured to receive the first helical beam (H) and form a second helical beam (L) output in a constant direction and transmits the second helical beam (L). The radio signal transmitting antenna (10) can transmit a helical beam (L) for OAM with a simplified and smaller device configuration.

7 Claims, 25 Drawing Sheets

(51) Int. Cl.

| | |
|---|---|
| ***H01Q 21/20*** | (2006.01) |
| ***H01Q 25/04*** | (2006.01) |
| ***H01Q 3/40*** | (2006.01) |
| ***H01Q 19/19*** | (2006.01) |
| ***H01Q 15/16*** | (2006.01) |
| ***H01Q 15/22*** | (2006.01) |

(52) U.S. Cl.
CPC ..... *H01Q 19/06* (2013.01); *H01Q 19/062* (2013.01); *H01Q 19/19* (2013.01); *H01Q 21/20* (2013.01); *H01Q 25/04* (2013.01)

(56) References Cited

U.S. PATENT DOCUMENTS

| | | | | |
|---|---|---|---|---|
| 2015/0372398 | A1* | 12/2015 | Dudorov ..... | H01Q 25/008 342/368 |
| 2016/0028163 | A1 | 1/2016 | Li et al. | |

FOREIGN PATENT DOCUMENTS

| | | | |
|---|---|---|---|
| WO | 2012/084039 | A1 | 6/2012 |
| WO | 2012/175629 | A1 | 12/2012 |
| WO | 2014/104911 | A1 | 7/2014 |
| WO | 2014/199451 | A1 | 12/2014 |
| WO | WO2015/132618 | * | 9/2015 |

OTHER PUBLICATIONS

International Search Report for PCT Application No. PCT/JP2015/005022, dated Dec. 22, 2015.

* cited by examiner (A)

(B)

(C)

(D)

31

RADIO SIGNAL TRANSMITTING ANTENNA, RADIO SIGNAL RECEIVING ANTENNA, RADIO SIGNAL TRANSMISSION/RECEPTION SYSTEM, RADIO SIGNAL TRANSMITTING METHOD, AND RADIO SIGNAL RECEIVING METHOD

This application is a National Stage Entry of PCT/JP2015/005022 filed on Oct. 1, 2015, the contents of all of which are incorporated herein by reference, in their entirety.

TECHNICAL FIELD

The present invention relates to a radio signal transmitting antenna, a radio signal receiving antenna, a radio signal transmitting system, a radio signal transmitting method, and a radio signal receiving method that form a signal into a helical beam to perform radio communication.

BACKGROUND ART

Currently, communication in the frequency band used for radio communication is coming close to reaching a limit. In order to solve this problem, a communication technique has been studied in which Orbital Angular Momentum (OAM) is given to a radio signal, and the signal is formed into a helical beam for transmission and reception. The signal from which the helical beam is formed has a feature that the equiphase surface rotates in a helical manner. A change in a helical rotation pitch of the equiphase surface included in the helical beam enables a signal in an infinite orthogonal mode to be formed. Thus, when a helical beam is used for radio communication, a plurality of communications can be established at the same frequency, and communication can be performed at a high speed and with a large capacity.

Examples of documents relating to an antenna using signals for a helical beam provided with orbital angular momentum include Patent Literature 1 to 3. Patent Literature 1 discloses an antenna for OAM including N (N is an integer of two or greater) antenna elements arranged at equal intervals on a concentric circle. The antenna for OAM outputs signals radiated from the antenna elements with a phase difference and forms a helical beam to which an orbital angular momentum is given. Patent Literature 2 discloses an antenna device including a wave source that outputs a signal having linear polarization or circular polarization and an OAM filter that forms a signal output from the wave source into a helical beam to which an orbital angular momentum is given. Patent Literature 3 discloses a transmitting antenna including a plurality of first wave sources that transmit a plurality of helical beams having orbital angular momentum in a plurality of modes and a parabolic second wave source that reflects the plurality of helical beams.

CITATION LIST

Patent Literature

Patent Literature 1: International Patent Publication No. WO2012/084039

Patent Literature 2: Japanese Unexamined Patent Application Publication No. 2015-27042

Patent Literature 3: International Patent Publication No. WO2014/199451

SUMMARY OF INVENTION

Technical Problem

According to the OAM antenna described in Patent Literature 1, the helical beam is formed using the signals radiated from the plurality of signal elements when the helical beam is formed and the signal is transmitted. In order to transmit the helical beam far away, it is necessary to expand the electromagnetic field distribution in the beam width direction for transmission. Therefore, to form signals for a helical beam in which the electromagnetic field distribution is expanded in the beam width direction, N signal elements need to be arranged on a circumference having a radius larger than that of an existing circumference. However, by doing so, the signals radiated from the respective signal elements interfere with each other to generate a grating, thereby degrading the helical beam to be formed. In order to reduce the degradation of the helical beam, it is necessary to arrange N or more additional signal elements on this circumference so that the distance between the signal elements becomes narrower, resulting in an increase in size and complexity of the configuration.

According to the antenna device for OAM described in Patent Literature 2, it is necessary to include a plurality of OAM filters corresponding to the respective modes in order to form helical beams of different modes. This complicates the device configuration when the helical beams of the plurality of modes are transmitted. According to the transmitting antenna for OAM described in Patent Literature 3, a plurality of first wave sources corresponding to the respective modes need to be included in order to form helical beams of different modes. This complicates the device configuration when the helical beams of the plurality of modes are transmitted.

An object of the present invention is to provide a radio signal transmitting antenna, a radio signal receiving antenna, a radio signal transmitting system, a radio signal transmitting method, and a radio signal receiving method for OAM that are capable of transmitting or receiving a helical beam with a simplified and smaller device configuration in an antenna for OAM that forms a signal into a helical beam.

Solution to Problem

A radio signal transmitting antenna according to the present invention includes:

a first wave source including a plurality of antenna elements configured to form a first helical beam for OAM (Orbital Angular Momentum) from the plurality of antenna elements and output the first helical beam; and a second wave source configured to receive the first helical beam and form a second helical beam output in a constant direction and transmits the second helical beam.

A radio signal transmitting antenna according to the present invention includes:

a first wave source including a plurality of antenna elements configured to form a first helical beam for OAM (Orbital Angular Momentum) from the plurality of antenna elements and output the first helical beam; and a second wave source configured to receive the first helical beam and form a second helical beam including a second electromagnetic field distribution, the second electromagnetic field distribution being an expanded first electromagnetic field distribution included in the first helical beam.

A radio signal receiving antenna according to the present invention includes:

second receiving means for receiving a second helical beam for OAM (Orbital Angular Momentum) and converting the second helical beam into a third helical beam including a third electromagnetic field distribution to concentrate power, the third electromagnetic field distribution being a reduced second electromagnetic field distribution included in the second helical beam; and first receiving means including a plurality of antenna elements for receiving the third helical beam from the plurality of antenna elements.

A radio signal transceiver system according to the present invention includes:

a radio signal transmitting antenna including:

a first wave source including a plurality of antenna elements configured to form a first helical beam for OAM (Orbital Angular Momentum) from the plurality of antenna elements and output the helical beam; and a second wave source configured to receive the first helical beam and form a second helical beam including a second electromagnetic field distribution, the second electromagnetic field distribution being an expanded first electromagnetic field distribution included in the first helical beam;

a radio signal receiving antenna including:

second receiving means for receiving the second helical beam and converting the second helical beam into a third helical beam including a third electromagnetic field distribution to concentrate power, the third electromagnetic field distribution being the reduced second electromagnetic field distribution; and first receiving means including a plurality of antenna elements for receiving the third helical beam from the plurality of antenna elements.

A radio signal transmitting method according to the present invention includes:

forming a first helical beam for OAM (Orbital Angular Momentum) from a plurality of antenna elements and outputting the first helical beam; and receiving the first helical beam and forming a second helical beam including a second electromagnetic field distribution, the second electromagnetic field distribution being an expanded first electromagnetic field distribution included in the first helical beam.

A radio signal receiving method according to the present invention includes:

receiving a second helical beam for OAM (Orbital Angular Momentum) and converting the second helical beam into a third helical beam including a third electromagnetic field distribution to concentrate power, the third electromagnetic field distribution being the reduced second electromagnetic field distribution; and receiving the third helical beam from a plurality of antenna elements.

Advantageous Effects of Invention

According to the radio signal transmitting antenna, the radio signal receiving antenna, the radio signal transmitting system, the radio signal transmitting method, and the radio signal receiving method of the present invention, it is possible to transmit or receive a helical beam for OAM with a simplified and smaller device configuration.

DESCRIPTION OF EMBODIMENTS

Hereinafter, embodiments of the present invention will be described with reference to the drawings.

First Embodiment

Figure 1:
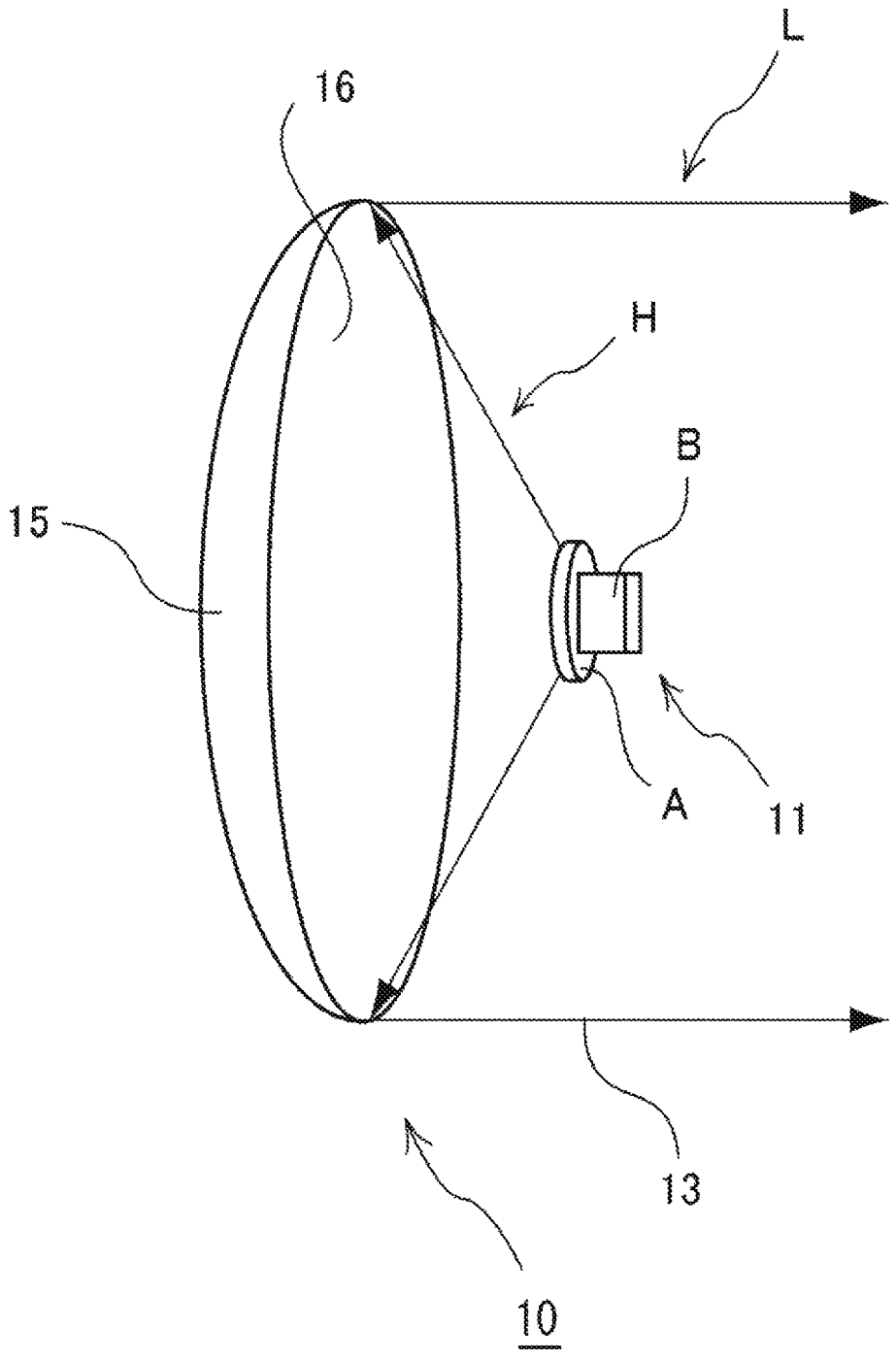
FIG. 1 is a diagram showing a configuration of a radio transmitting antenna according to a first embodiment of the present invention.

As shown in FIG. 1, a radio transmitting antenna 10 includes a primary radiator (a first wave source) that forms and outputs a helical beam (a first helical beam) H for OAM (Orbital Angular Momentum) 11, and a parabolic mirror part (first reflecting means or a second wave source) 15 that collects the output helical beam H to form a helical beam (a second helical beam) L and outputs it in a constant direction. That is, in the radio transmitting antenna 10, the helical beam H output from the primary radiator 11 is reflected by the parabolic mirror part 15 and then transmitted in a constant direction as the helical beam L.

The parabolic mirror part 15 is a bowl-shaped radio wave reflecting part including a parabolic surface 16 formed on a front surface. The parabolic mirror part 15 is formed of a metal material such as stainless steel or aluminum. The primary radiator 11 is disposed on a front side of the parabolic mirror part 15. The primary radiator 11 is disposed to irradiate the parabolic mirror part 15 with the helical beam H. The primary radiator 11 includes signal radiating means A that radiates the helical beam H and a signal distribution circuit B that distributes signals to the signal radiating means A. The primary radiator 11 is disposed on the side of the front surface of the parabolic surface 16 of the parabolic mirror part 15. For example, the primary radiator 11 is disposed in such a way that the signal radiating means A is at near a position to be a focal point of the parabolic surface 16 of the parabolic mirror part 15.

The primary radiator 11 is fixed to the parabolic mirror part 15 by, for example, a stay (not shown). The helical beam H radiated from the signal radiating means A is collected (received) by the parabolic surface 16 of the parabolic mirror part 15 and is reflected in the constant direction (a direction of arrows 13). The reflected wave of the helical beam H is formed into the helical beam L, and the helical beam L is output in the direction of the arrows 13. The parabolic mirror part 15 receives the helical beam H, expands an electromagnetic field distribution included in the helical beam H, forms the helical beam L having a second electromagnetic field distribution that is larger than the first electromagnetic field distribution, and then outputs the helical beam L.

That is, the radio transmitting antenna 10 can transmit the helical beam L having the expanded electromagnetic field distribution from the parabolic mirror part 15 in the constant direction. According to the radio transmitting antenna 10, the first electromagnetic field distribution of the helical beam H formed by the primary radiator is expanded by the parabolic mirror part 15 as the second electromagnetic field distribution. The second electromagnetic field distribution is wider than the first electromagnetic field distribution in a beam width direction with respect to a direction in which the helical beam H travels. Thus, the size of the primary radiator 11 can be reduced.

Second Embodiment

Figure 2:
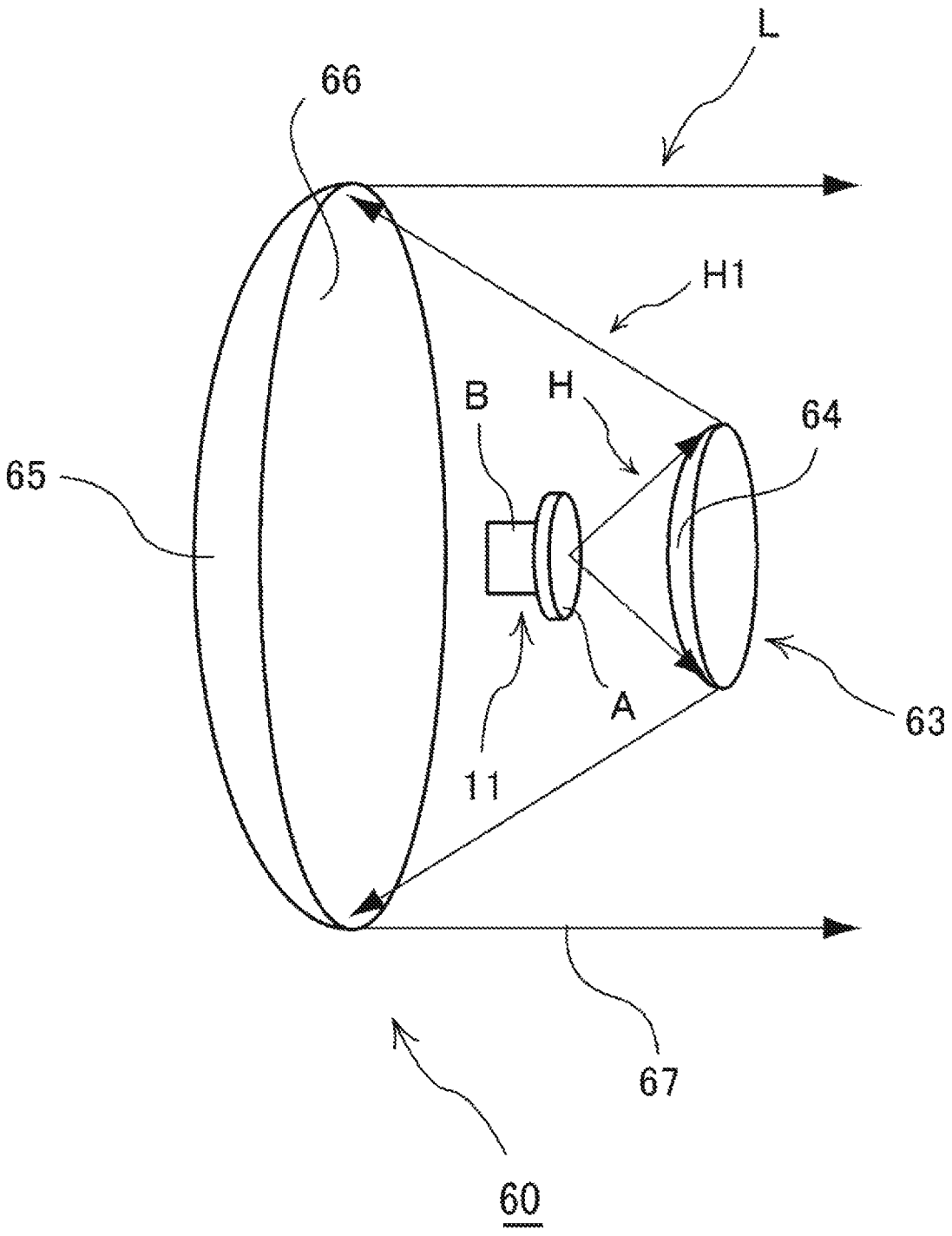
FIG. 2 is a diagram showing a configuration of a radio transmitting antenna according to a second embodiment of the present invention.

As shown in FIG. 2, a radio transmitting antenna 60, which is a modified example of the radio transmitting antenna 10, will be described. In this embodiment, the same components as those of the radio transmitting antenna 10 are denoted by the same reference terms and signs, the components having functions similar to those of the radio transmitting antenna 10 are denoted by the same reference terms, and repeated descriptions will be omitted as appropriate. This applies to the following embodiments.

The radio transmitting antenna 60 includes a primary radiator 11 that forms and outputs a helical beam H, a sub-reflecting mirror part (second reflecting means) 63 that reflects the output helical beam H, and a parabolic mirror part (first reflecting means or a second wave source) 65 that collects the reflected helical beam H, forms a helical beam L, and outputs the helical beam L in a constant direction. That is, in the radio transmitting antenna 60, the helical beam H output from the primary radiator 11 is indirectly reflected by the sub-reflecting mirror part 63 and then reflected by the parabolic mirror part 65 to be formed into the helical beam L. Then, the helical beam L is output in the constant direction.

The parabolic mirror part 65 is a bowl-shaped radio wave reflecting part including a parabolic surface 66 formed on a front surface. The sub-reflecting mirror part 63 is disposed to face the parabolic mirror part 65 on a front side thereof. The primary radiator 11 is disposed between the parabolic mirror part 65 and the sub-reflecting mirror part 63. The sub-reflecting mirror part 63 is a bowl-shaped radio wave reflecting part including a hyperboloid surface 64. The sub-reflecting mirror part 63 is disposed in such a way that a convex part of the hyperboloid surface 64 faces the parabolic surface 66. The primary radiator 11 is disposed in such a way that the sub-reflecting mirror part 63 is irradiated with the helical beam H. That is, the radio transmitting antenna 60 has a shape of a Cassegrain antenna.

The helical beam H radiated from the primary radiator 11 is reflected to be diffused by the sub-reflecting mirror part 63. The reflected wave is output as a helical beam H1. The helical beam H1 is collected by the parabolic mirror part 65 and is reflected in a constant direction (a direction of arrows 67). The primary radiator 11 and the sub-reflecting mirror part 63 are arranged in such a positional relationship that the helical beam H1 is radiated from a focal point of the parabolic surface 66. According to the radio transmitting antenna 60, when the size of the parabolic mirror part 65 is increased, a length of a waveguide (not shown) connected to the primary radiator 11 can be reduced, thereby reducing a transmission loss.

Third Embodiment

Figure 3:
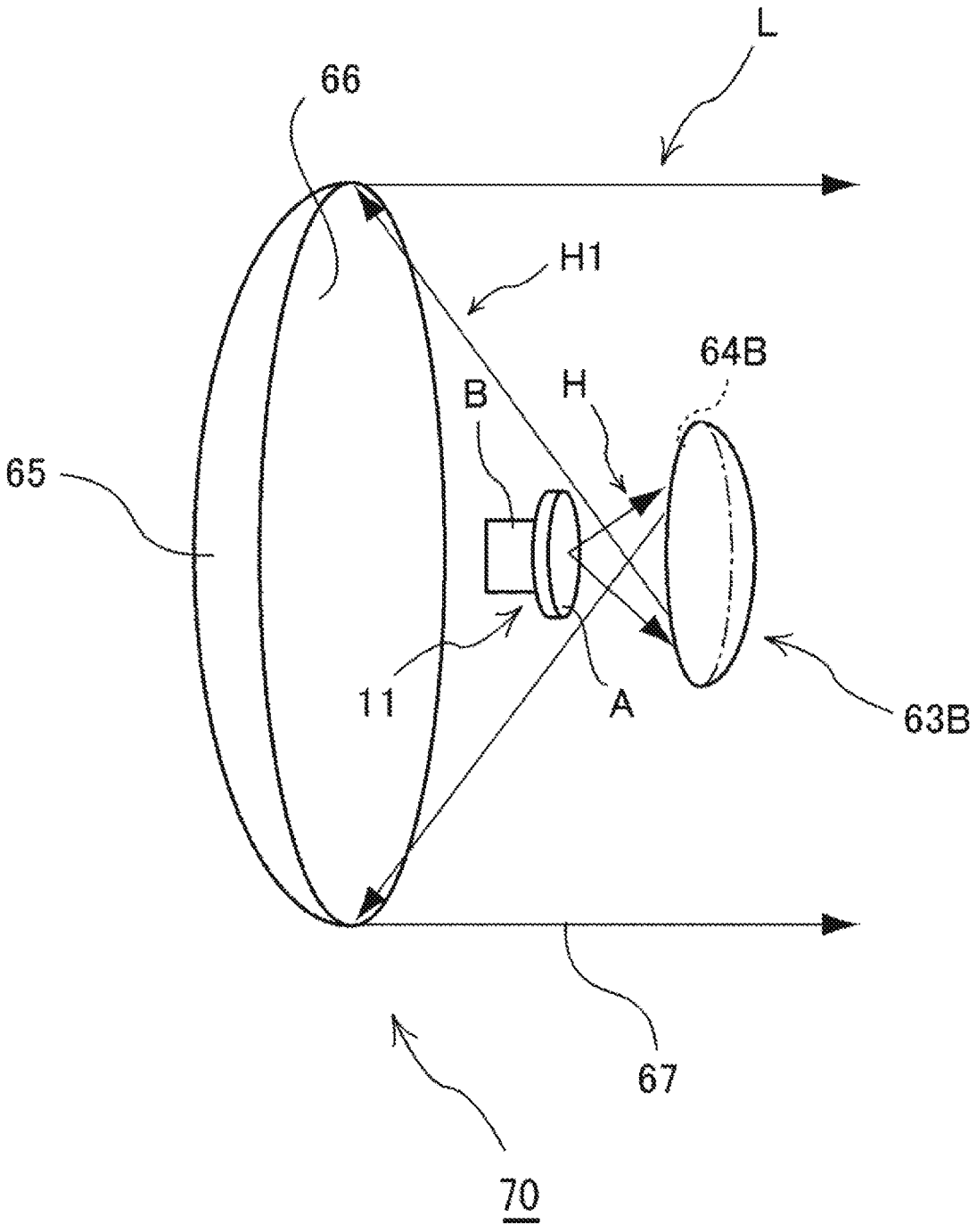
FIG. 3 is a diagram showing a configuration of a radio transmitting antenna according to a third embodiment of the present invention.

As shown in FIG. 3, a radio transmitting antenna 70 may have a configuration including a sub-reflecting mirror part 63B in which a rotation ellipsoid surface 64B is formed in place of the sub-reflecting mirror part 63 of the radio transmitting antenna 60. The sub-reflecting mirror part 63B is disposed in such a way that a concave part of the rotation ellipsoid surface 64B faces a parabolic surface 66. That is, the radio transmitting antenna 70 has a shape of a Gregorian antenna. According to the radio transmitting antenna 70, when the size of the parabolic mirror part 65 is increased, a length of a waveguide (not shown) connected to the primary radiator 11 can be reduced, thereby reducing a transmission loss.

Fourth Embodiment

Figure 4:
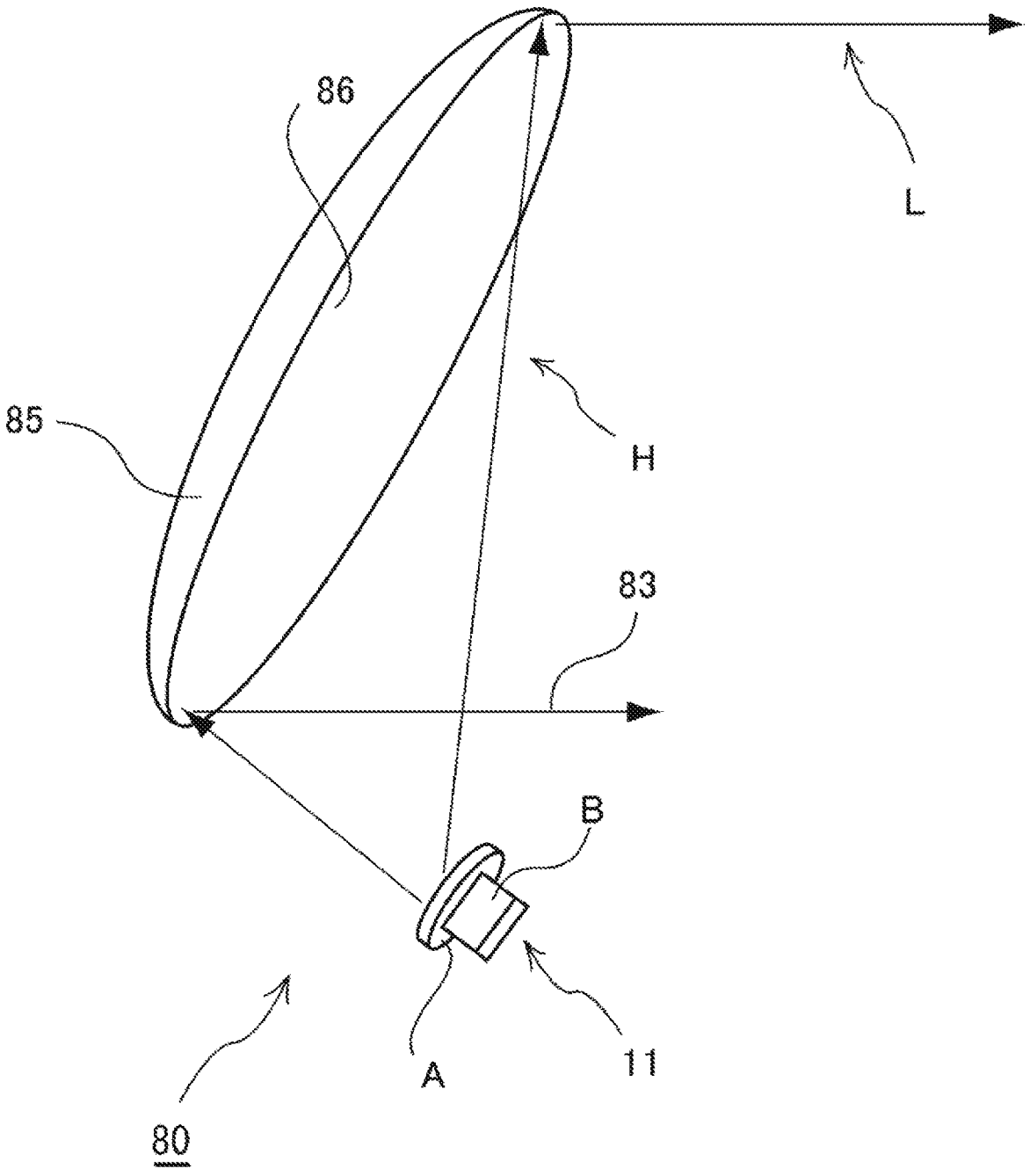
FIG. 4 is a diagram showing a configuration of a radio transmitting antenna according to a fourth embodiment of the present invention.

As shown in FIG. 4, in a radio transmitting antenna 80, a parabolic mirror part (first reflecting means or a second wave source) 85 is disposed in such a way that a parabolic surface 86 is offset from the primary radiator 11. That is, the radio transmitting antenna 80 has a shape of an offset antenna. According to the radio transmitting antenna 80, a primary radiator 11 disposed at a focal position with respect to the parabolic mirror part 85 will not become an obstacle, and a mounting angle of the parabolic mirror part 85 to a ground surface (not shown) becomes steep. This achieves an effect that hardly any foreign objects, snow, etc. pile up on the parabolic mirror part 85.

Fifth Embodiment

Figure 5:
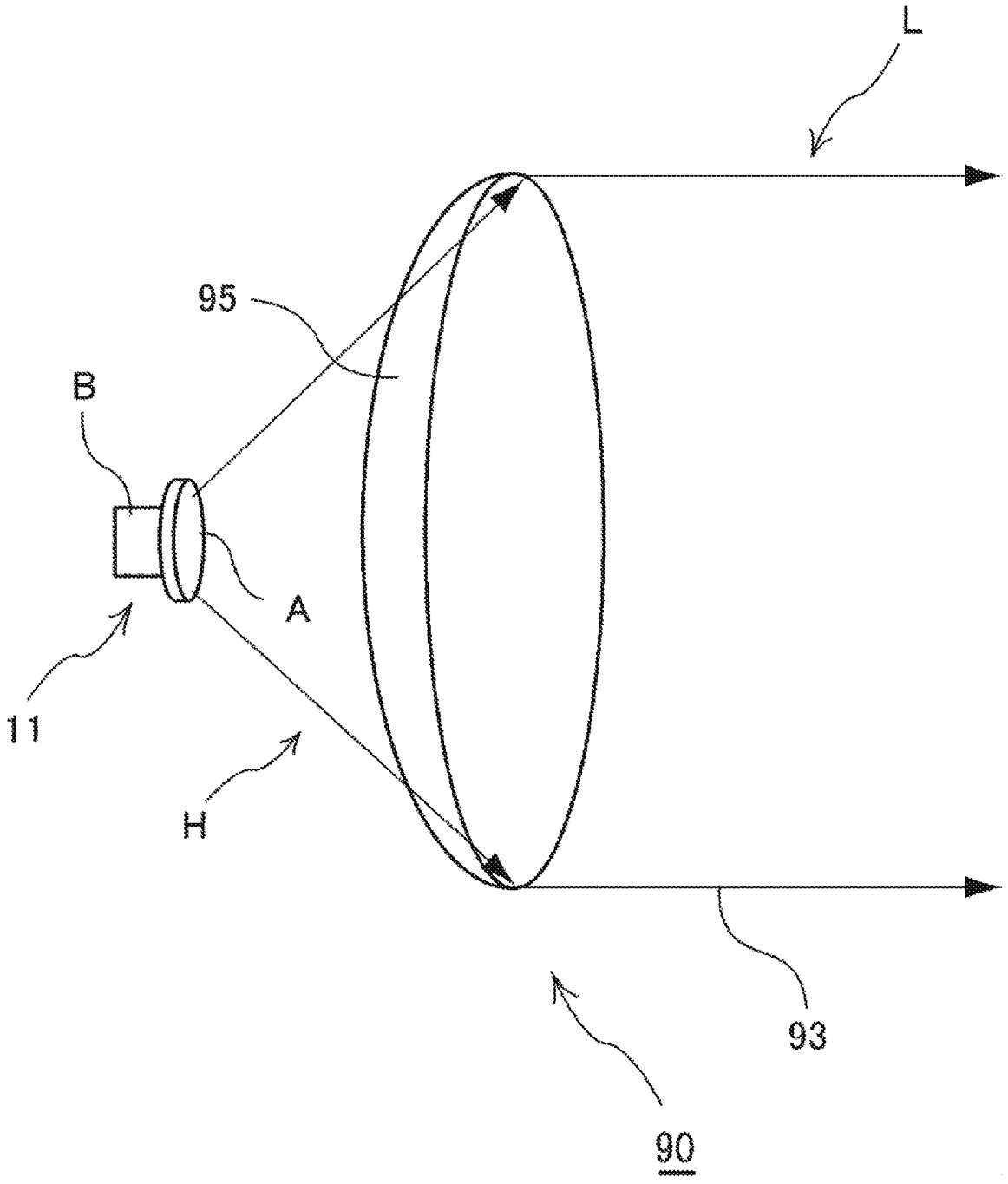
FIG. 5 is a diagram showing a configuration of a radio transmitting antenna according to a fifth embodiment of the present invention.

As shown in FIG. 5, a radio transmitting antenna 90 includes a primary radiator (a first wave source) 11 that forms and outputs a helical beam H for OAM and a lens surface part (first reflecting means or a second wave source) 95 that collects the output helical beam H to form a helical beam (a second helical beam) L and output it in a constant direction. That is, in the radio transmitting antenna 10, the helical beam H output from the primary radiator 11 is reflected by the lens surface part 95, formed into a helical beam L, and transmitted in a constant direction.

The lens surface part 95 is a radio wave refracting part whose entire surface is formed into a convex lens shape. The lens surface part 95 is molded using, for example, a lens medium that transmits radio waves. The primary radiator 11 is disposed on a rear side of the lens surface part 95. The primary radiator 11 is disposed to irradiate a rear part of the lens surface part 95 with the helical beam H. The primary radiator 11 is disposed in such a way that the signal radiating means A is at a focal point of the lens surface part 95. The primary radiator 11 is fixed to the lens surface part 95 by, for example, a stay (not shown).

The helical beam H radiated from the signal radiating means A is collected by the lens surface part 95 and is refracted in a constant direction (a direction of arrows 93). The refracted wave of the helical beam H is formed into a parallel helical beam L, and the helical beam L is output in the direction of the arrows 93. That is, the radio transmitting antenna 10 can transmit the parallel helical beam L from the lens surface part 95 in the constant direction. According to the radio transmitting antenna 90, the electromagnetic field distribution of the helical beam H radiated from the primary radiator is expanded by the lens surface part 95 in a beam width direction with respect to a direction in which the helical beam H travels. Thus, the size of the primary radiator 11 can be reduced.

Next, the primary radiator 11 common to the first to fifth embodiments will be described in detail.

Figure 6:
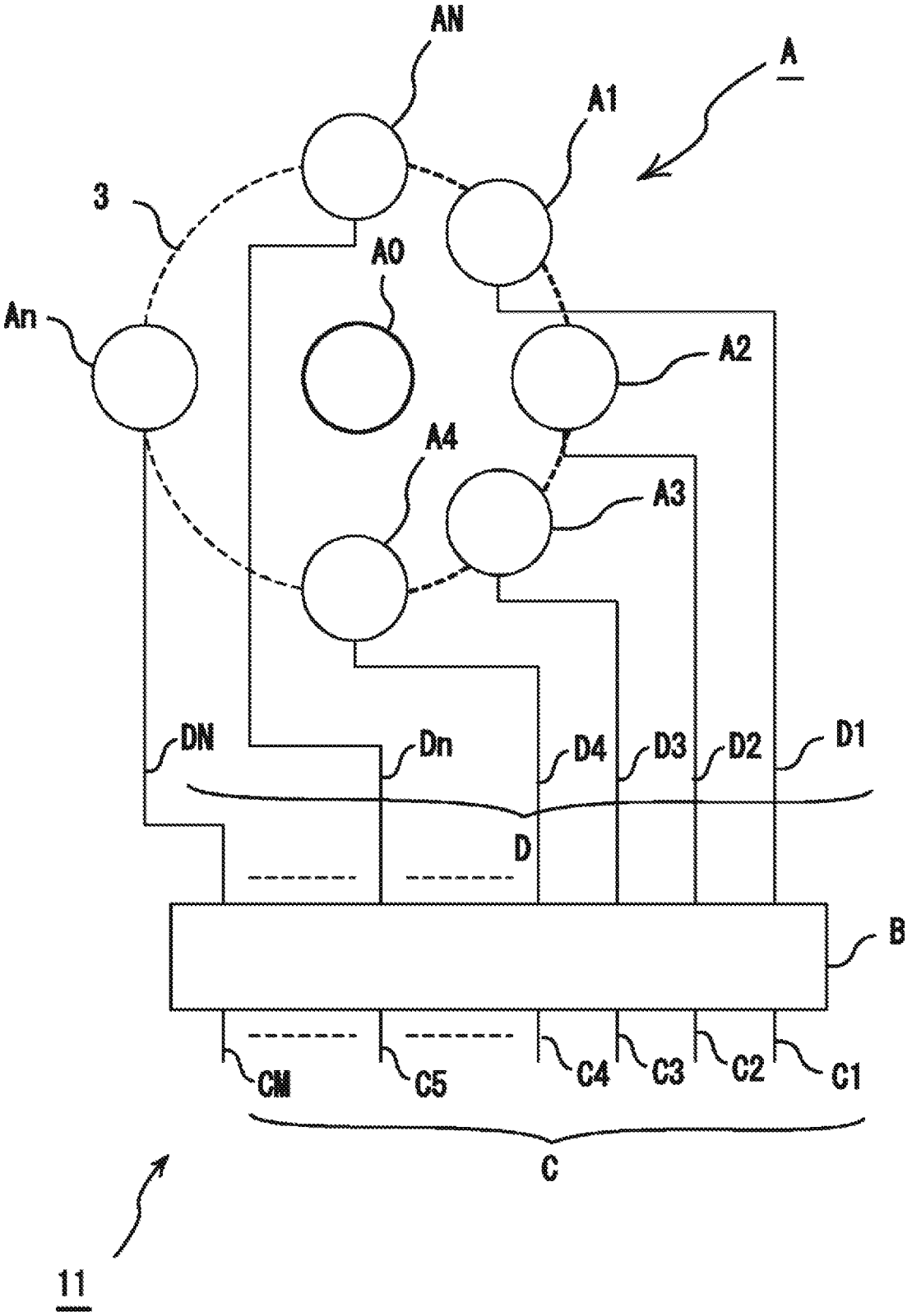
FIG. 6 is a block diagram showing a configuration of a primary radiator included in a radio transmitting antenna.

As shown in FIG. 6, the primary radiator 11 includes the signal radiating means A including N (N is an integer of two or greater) antenna elements A1, A2 to AN evenly arranged on a circumference, a signal input port (signal input means) C that inputs M (M is a positive integer) first signals S1 to SM, and a signal distribution circuit (signal distribution means) B that distributes the input M first signals S1 to SM to N second signals S2 having equal power and outputs the second signals S2 to the antenna elements A1, A2 to AN, respectively. With such a configuration, the radio transmitting antenna 10 forms the helical beam H from the input M first signals S1 to SM and outputs the helical beam H from the antenna elements A1, A2 to AN.

The antenna elements A1 to AN are evenly arranged on a circumference 3 (a ring array). A radius of the circumference 3 is about one wavelength of the signal to be transmitted. The plurality of the antenna elements A1 to AN constitute the signal radiating means A. Any element may be used as the antenna elements A1 to AN as long as it can radiate a signal. The signal radiating means A is connected to the signal distribution circuit B by a signal waveguide D. The signal waveguide D includes N equal length signal lines D1 to DN. The signal lines D1 to DN connect N signal radiation ports B1 to BN included in the signal distribution circuit B to the antenna elements A1 to AN, respectively. A coaxial cable or a waveguide can be used as the signal lines D1 to DN.

An antenna element A0 radiating signals in a normal mode (non-OAM mode), which is not the OAM mode, may be provided at the center of the signal radiating means A. That is, the signal radiating means A may further include the antenna element A0 that outputs signals in the non-OAM mode. The antenna element A0 may be disposed at a position other than the center of the signal radiating means A. A waveguide branched from any one of the signal radiation ports B1 to BN may be connected to the antenna element A0, or a circuit for other signals that outputs signals in the normal mode may be connected to the antenna element A0.

The signal distribution circuit B distributes the first signal S input from some of the M signal input ports C1 to CM to N second signals G1 to GN having equal power and radiates the second signals G1 to GN from the signal radiation ports B1 to BN, respectively. For example, a Butler matrix feeder circuit can be used as the signal distribution circuit B. The Butler matrix is commonly used for changing the direction of transmitting beams. The Butler matrix is used for analog multiplexing or demultiplexing RF (Radio Frequency) or IF (Intermediate Frequency) mode.

Figure 7:
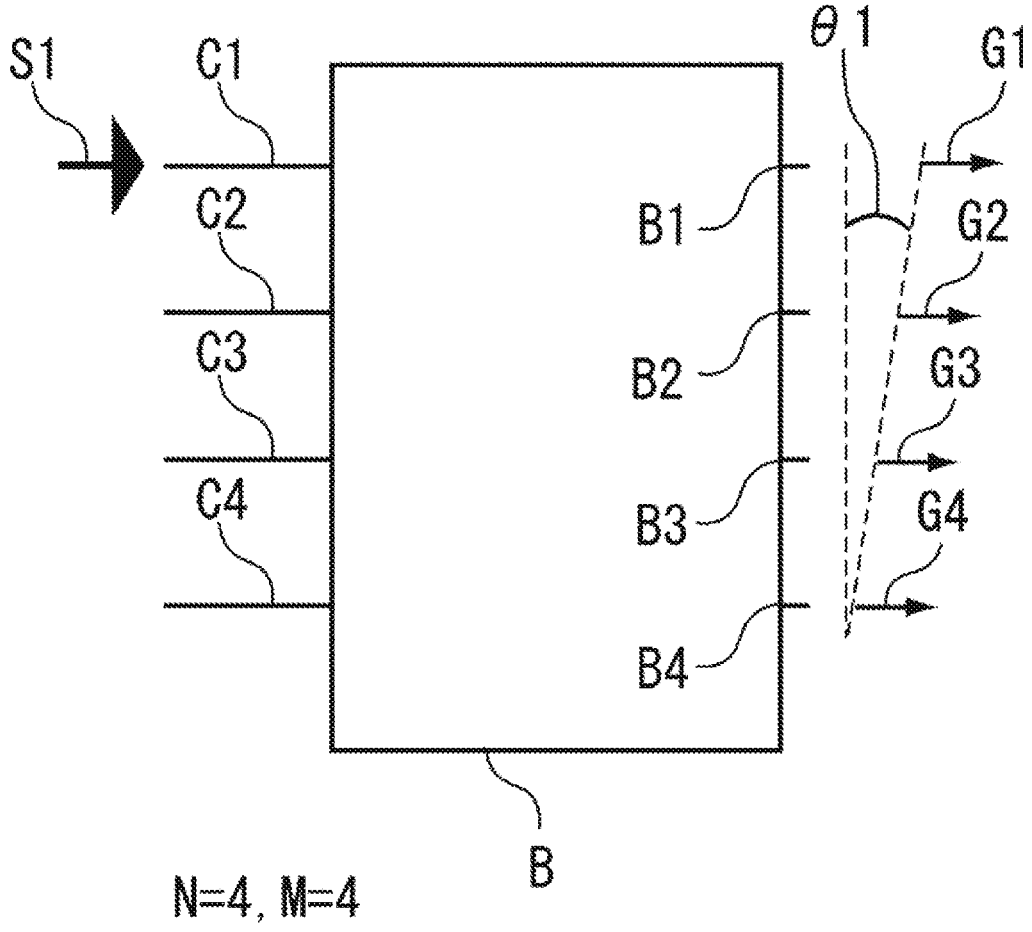
FIG. 7 is a diagram showing a principle of a signal distribution circuit using a Butler matrix feeder circuit.

As shown in FIG. 7, according to the signal distribution circuit B using the Butler matrix feeder circuit, when the first signal S1 is input from the signal input port C1, the N second signals G1 to GN having equal power are distributed and output from the signal radiation ports B1 to BN, respectively. At this time, the signal distribution circuit B gives a phase difference having a linear slope θ1 to each of the N second signals G1 to GN radiated from the signal radiation ports B1 to BN, respectively. The helical beam H is formed using this property. Specifically, the equal length signal lines D1 to DN are connected to the antenna elements A1 to AN from the signal radiation ports B1 to BN (see FIG. 6), respectively. Further, the antenna elements A1 to AN are evenly arranged on the circumference 3 (see FIG. 6).

Figure 8:
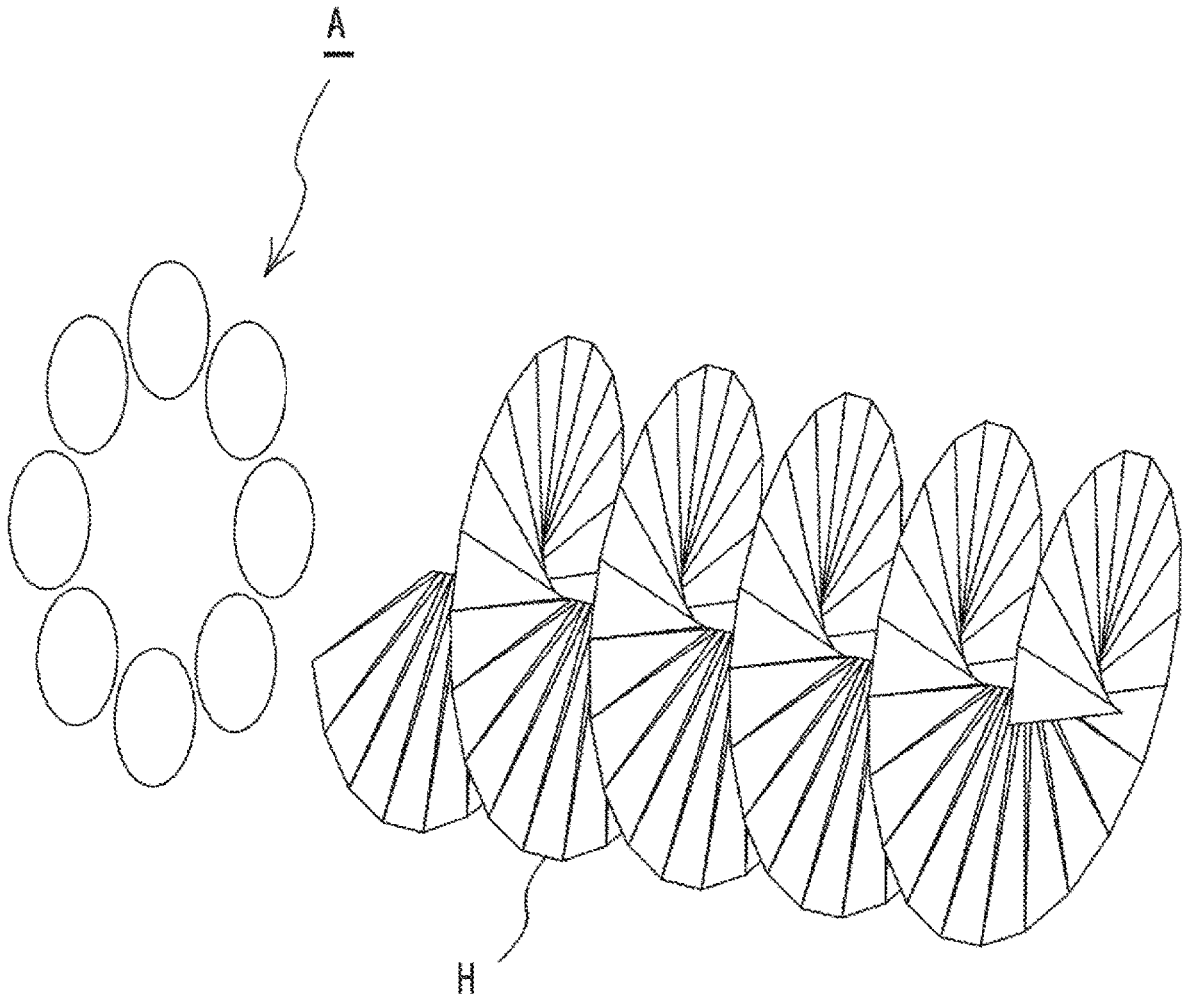
FIG. 8 is a diagram showing a state in which a helical beam is formed from signal radiating means A.

As shown in FIG. 8, when the second signals G1 to GN are sequentially radiated from the respective antenna elements A1 to AN at predetermined intervals in a fixed rotation direction (clockwise or counterclockwise), the helical beam H is formed from the signal radiating means A. The rotation direction of the helical beam is changed according to the connection between the antenna elements A1 to AN and the signal lines D1 to DN. In the OAM mode in which the helical beam H is formed, there may be a case where N=2. In the case of N=2, the rotation direction may be regarded as being either clockwise or counterclockwise. The rotation direction of the helical beam H can be determined when N is three or greater.

Figure 9:
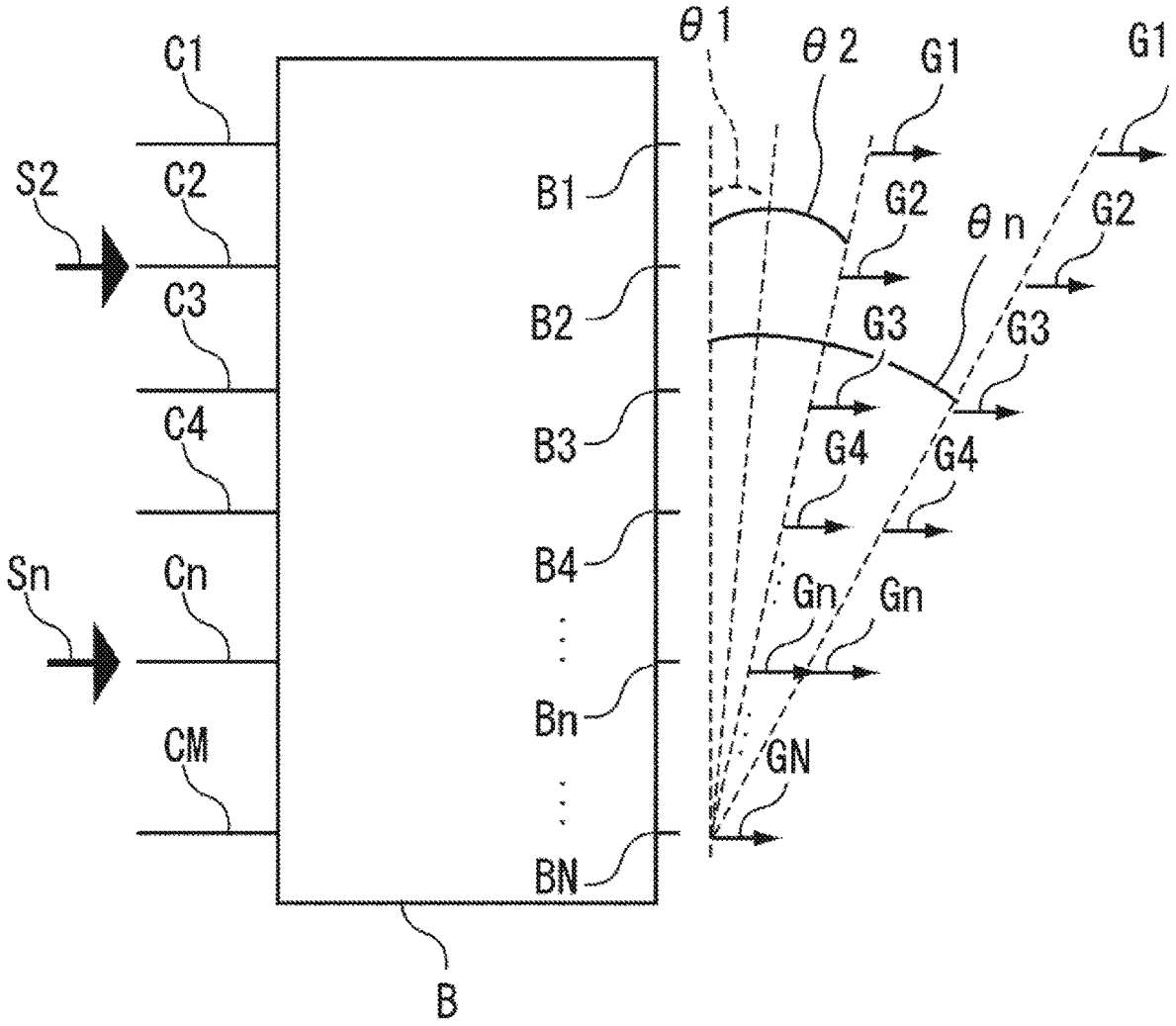
FIG. 9 is a diagram showing a principle of a signal distribution circuit using a Butler matrix feeder circuit having a plurality of input ports.

As shown in FIG. 9, the Butler matrix commonly includes a plurality of signal input ports C1 to CM (positive integer M≤N). To change the slope θN of the phase difference that linearly inclines and appears at the signal radiation ports B1 to BN, the signal input ports C1 to CM for inputting the first signals S1 to SM are changed. For example, the first signal S2 input to the signal input port C2 is output as the second signals G1 to GN provided with a phase difference of a linear slope θ2. Using this property, the helical rotation pitch of the helical beam H can be changed to correspond to the signal input ports C1 to CM. Specifically, the signal output from the signal radiating means A can be formed into the helical beam H having the helical rotation pitch corresponding to the signal input ports C1 to CM whose equiphase surface inclines in a helical manner.

That is, the signal distribution circuit B generates, from the input first signal S, the N second signals G1 to GN having phase differences from one another. Then, the signal distribution circuit B outputs the N second signals G1 to GN to the N antenna elements A1 to AN, respectively, so that the helical beam H with a helically inclined equiphase surface is output from the signal radiating means A. At this time, the signal distribution circuit B distributes the signals in such a way that the second signals G1 to GN having a predetermined phase difference that increases in a stepwise manner (with an equal difference) in the circumference direction are input to the antenna elements A1 to AN that are adjacent in the signal radiating means A.

In the above description, the Butler matrix feeder circuit is used as the signal distribution circuit B. Alternatively, any element may be used as the signal distribution circuit B as long as it can output the second signals G1 to GN in such a way that the helical beam H is formed from the antenna elements A1 to AN that are arranged at equal intervals on a circumference. The phase difference given to the second signals does not necessarily have to be equally spaced (with an equal difference).

As shown in FIGS. 10A to 10D, variations of the arrangement of the antenna elements A1 to AN include, in addition to the antenna elements A1 to AN being arranged on the circumference 3, the antenna elements A1 to AN being evenly arranged on a circumference 4 that is concentric with the circumference 3. Another arrangement of the signal radiating means A is, for example, a single circular ring in which eight antenna elements A1 to A8 are arranged on the circumference 3 (see FIG. 10A). Another arrangement of the signal radiating means A is a single rectangular ring in which the eight antenna elements A1 to A8 are arranged on the circumference 3 and the circumference 4 (see FIG. 10B). The signal radiating means A arranged in the single ring is supplied with power in 8 modes by, for example, an 8×8 Butler matrix circuit.

Figure 10A:
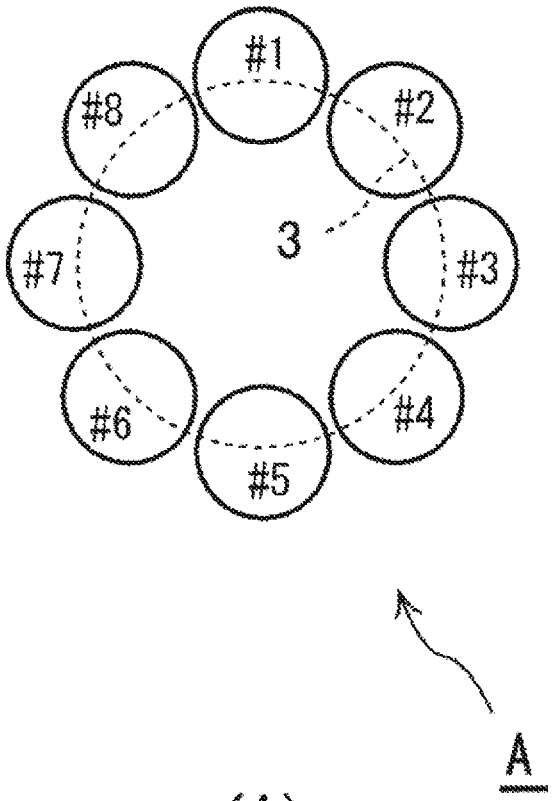
FIG. 10A is a diagram showing another arrangement of a plurality of antenna elements.
Figure 10B:
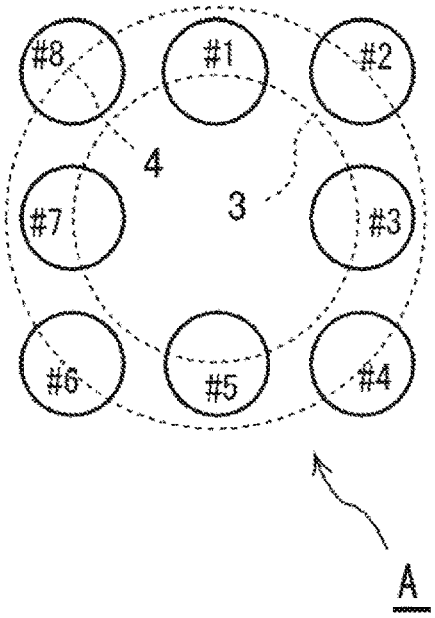
FIG. 10B is a diagram showing another arrangement of a plurality of antenna elements.
Figure 10C:
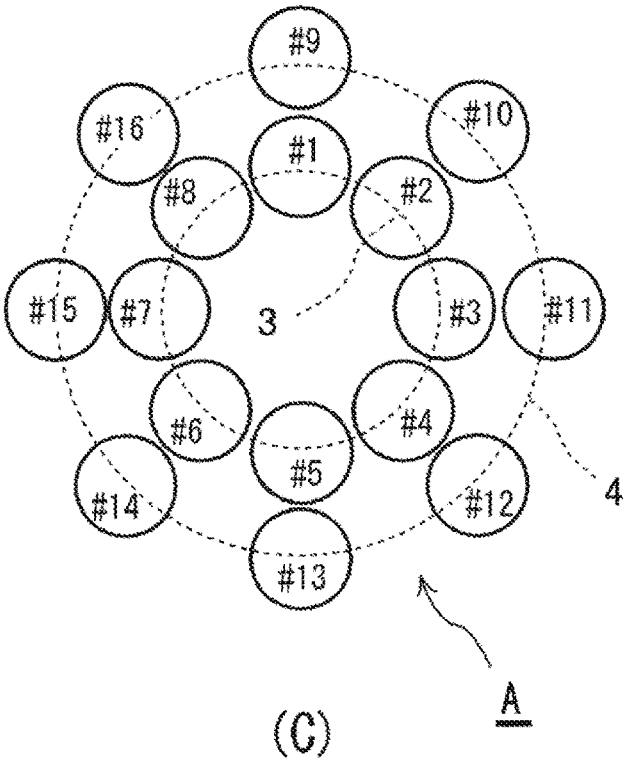
FIG. 10C is a diagram showing another arrangement of a plurality of antenna elements.
Figure 10D:
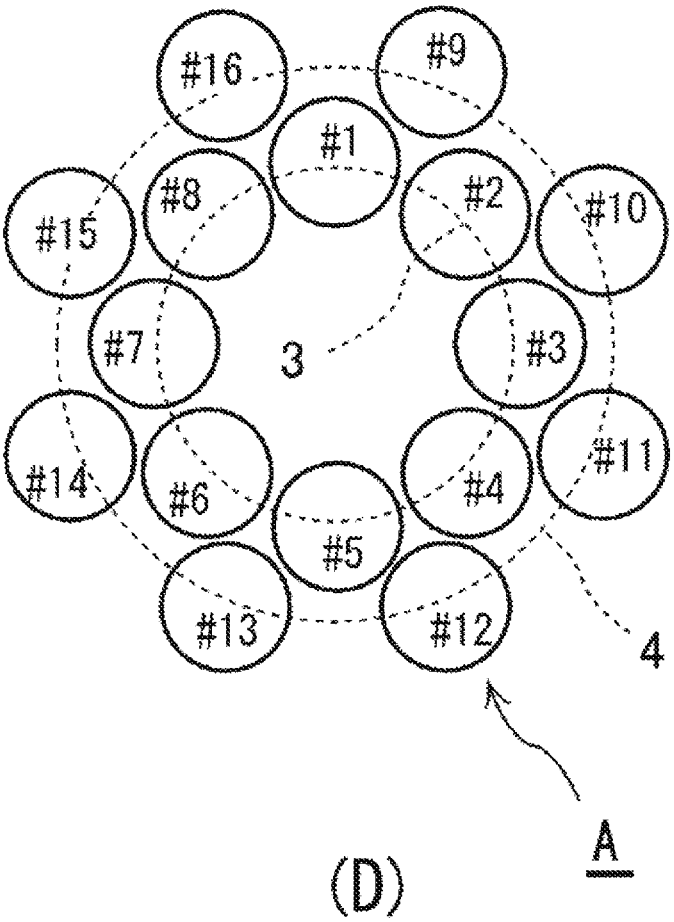
FIG. 10D is a diagram showing another arrangement of a plurality of antenna elements.

Another arrangement of the signal radiating means A is a double circular ring in which 16 antenna elements A1 to A16 are arranged on the circumference 3 and the circumference 4 (see FIGS. 10C and 10D). The signal radiating means A arranged in the form of a double ring is supplied with power in 8 modes, for example, by a 16×16 Butler matrix circuit.

According to this arrangement of the antenna elements A1 to AN, the distance between the antenna elements A1 to AN can be narrowed to the level of a wavelength. This prevents the signals radiated from the respective antenna elements A1 to AN from interfering with each other to generate a grating. Consequently, the helical beam H formed by the antenna elements A1 to AN is prevented from degrading by the arrangement of the antenna elements A1 to AN.

As described above, in the primary radiator 11, which is the first wave source, the distance between the antenna elements A1 to AN is narrowed, and thus the apparatus can be downsized to the level of a wavelength. In order to expand the electromagnetic field distribution in the beam width direction of the helical beam L radiated from the radio transmitting antenna 10 in the constant direction, the diameter of the parabolic mirror part 15, which is the second wave source, may be increased. This eliminates the need to increase the size of the device configuration of the primary radiator 11. Thus, the device configuration of the radio transmitting antenna 10 can be simplified when the electromagnetic field distribution is expanded in the beam width direction of the helical beam L. This also applies to the radio transmitting antennas 60, 70, 80, and 90.

Figure 11:
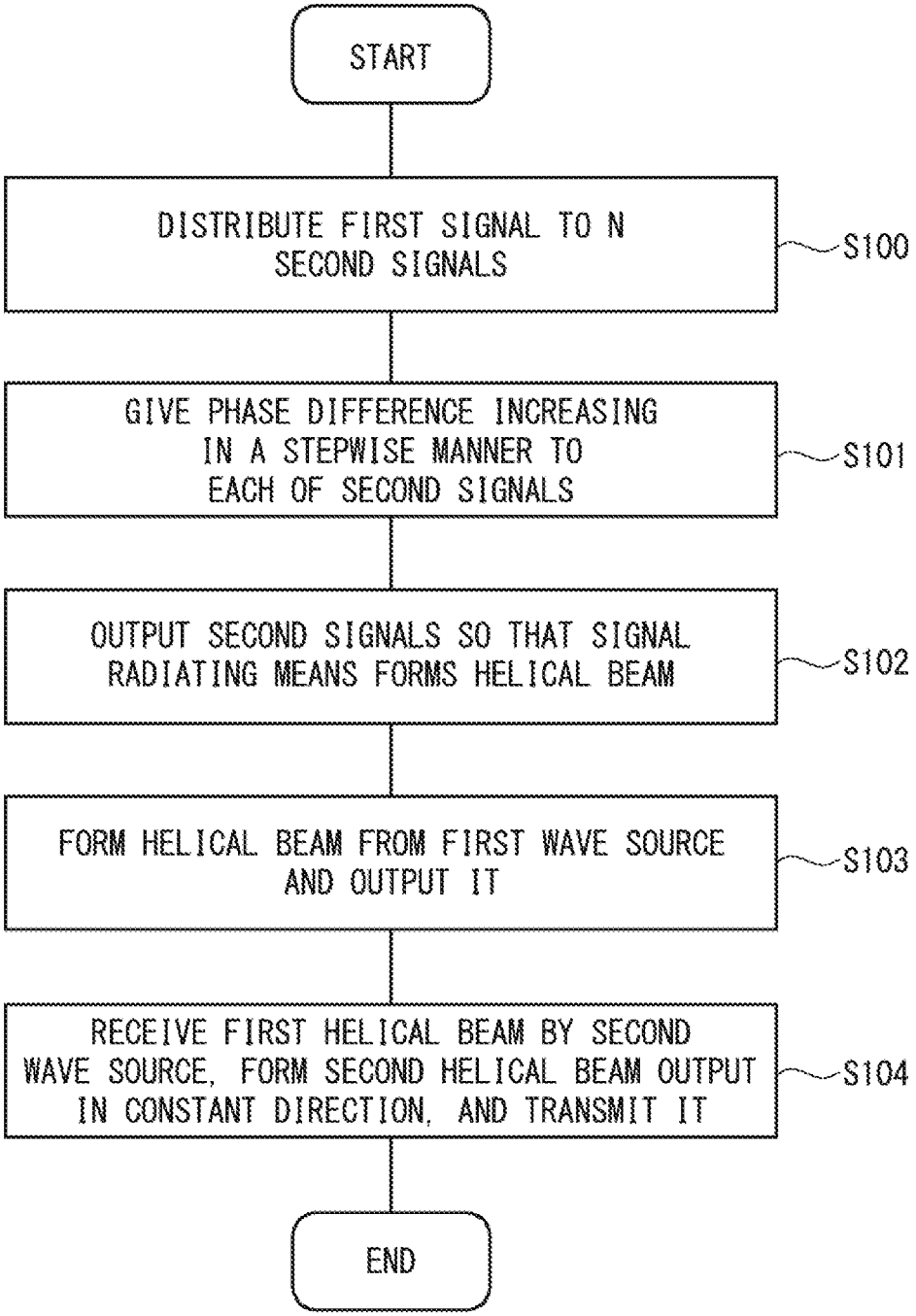
FIG. 11 is a flowchart showing a process in which a radio transmitting antenna forms a helical beam.

Next, the radio transmitting method for transmitting the helical beam L by the radio transmitting antenna 10 will be briefly described with reference to FIG. 11.

In the radio transmitting antenna 10, the first signal S input to any one of the signal input ports C1 to CM is distributed by the signal distribution circuit B to the N second signals G1 to GN having equal power (S100). The signal distribution circuit B gives the phase difference that increases in a stepwise manner to each of the N second signals G1 to GN to be output (S101). The signal distribution circuit B distributes the N second signals G1 to GN to the N antenna elements A1 to AN so that the helical beam H whose equiphase surface inclines in a helical manner is formed from the signal radiating means A (S102). Then, the primary radiator 11 (the first wave source) forms the helical beam (the first helical beam) H and outputs the helical beam H (S103). The parabolic mirror part (the second wave source) 15 collects the helical beam H, forms the helical beam (the second helical beam) L output in the constant direction, and transmits the helical beam L (S104).

As described above, the radio transmitting antenna 10 can form the signals output from the respective antenna elements A1 to AN into the helical beam H whose equiphase surface inclines in a helical manner. The radio transmitting antenna 10 can freely change the helical rotation pitch of the helical beam H when forming the signals into the helical beam H. Furthermore, the radio transmitting antenna 10 can expand the output helical beam H by the parabolic mirror surface part 15 and transmits it in the constant direction. Moreover, according to the radio transmitting antenna 10, the distance between the antenna elements A1 to AN of the primary radiator 11 is narrowed to the level of a wavelength. This prevents a grating from occurring and the helical beam H from degrading. In this way, the radio transmitting antenna 10 can downsize the primary radiator 11 to the level of a wavelength and simplify the device configuration.

Sixth Embodiment

In the first embodiment, the primary radiator 11 of the radio transmitting antenna 10 forms the signals output from the respective antenna elements A1 to AN into the helical beam whose equiphase surface inclines in a helical manner having a helical rotation pitch corresponding to the signal input ports C1 to CM. In this embodiment, a plurality of helical beams having different helical rotation pitches are formed using the radio transmitting antenna 10 to perform multiplexed communication. In the following description, the same elements as those of the first embodiment are denoted by the same reference terms and signs, and repeated descriptions will be omitted as appropriate.

Figure 12:
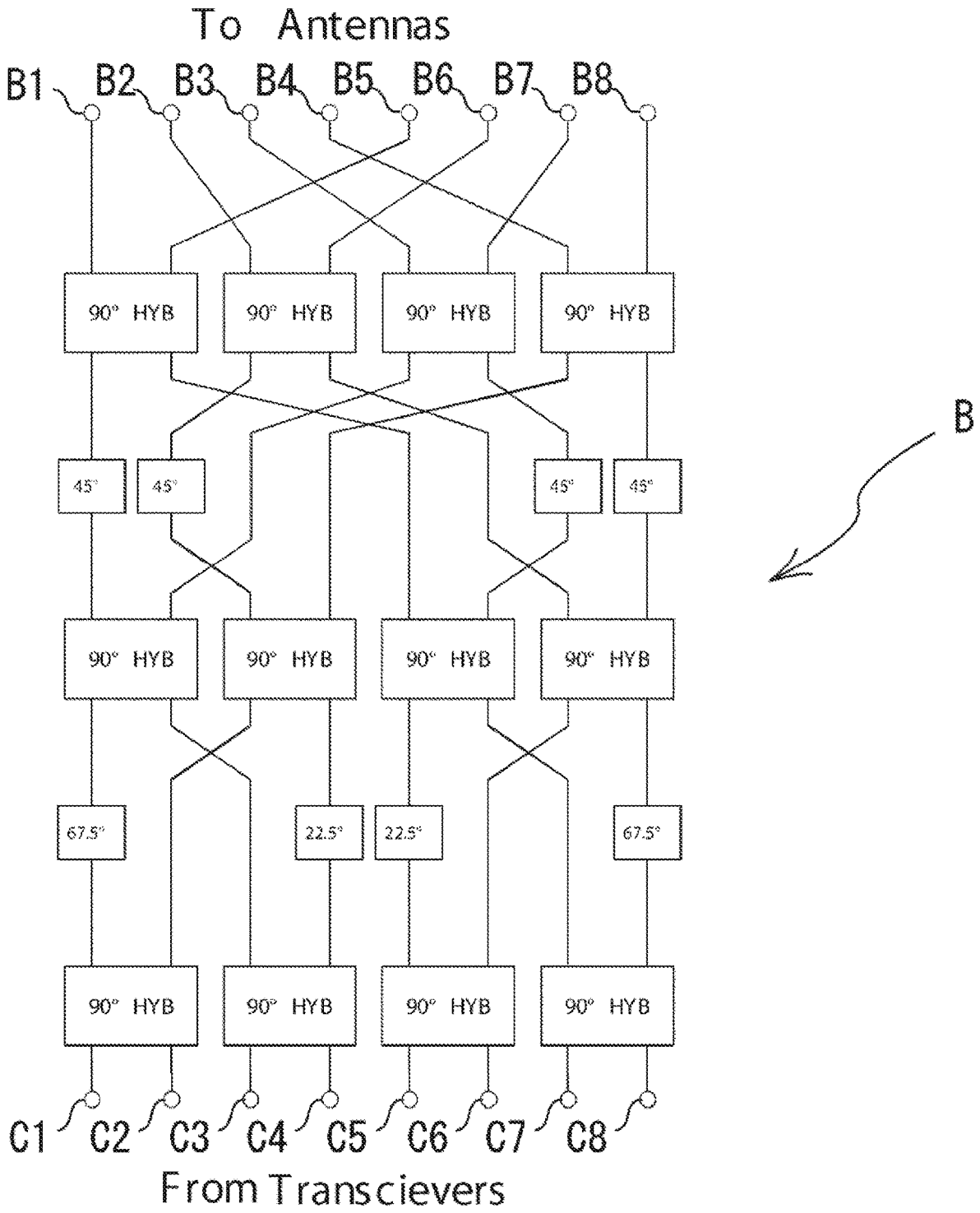
FIG. 12 is a diagram showing a configuration of a signal distribution circuit included in a radio transmitting antenna according to a sixth embodiment.

As shown in FIG. 12, the signal distribution circuit B of the radio transmitting antenna 10 includes a plurality of signal input ports C1 to CM and a plurality of signal radiation ports B1 to BN. FIG. 12 shows a configuration of the signal distribution circuit B having a Butler matrix feeder circuit with 8 (=M) inputs and 8 (=N) outputs. When the first signals S1 to SM are input to any of the signal input ports C1 to CM, phase differences having different linear slopes are given to the N second signals G1 to GN, and the N second signals having equal power are output from the signal radiation ports B1 to BN, respectively (see FIG. 9). Then, the input first signals S are formed into M helical beams H1 to HM having different helical rotation pitches corresponding to the signal input ports C1 to CM, respectively.

Figure 13:
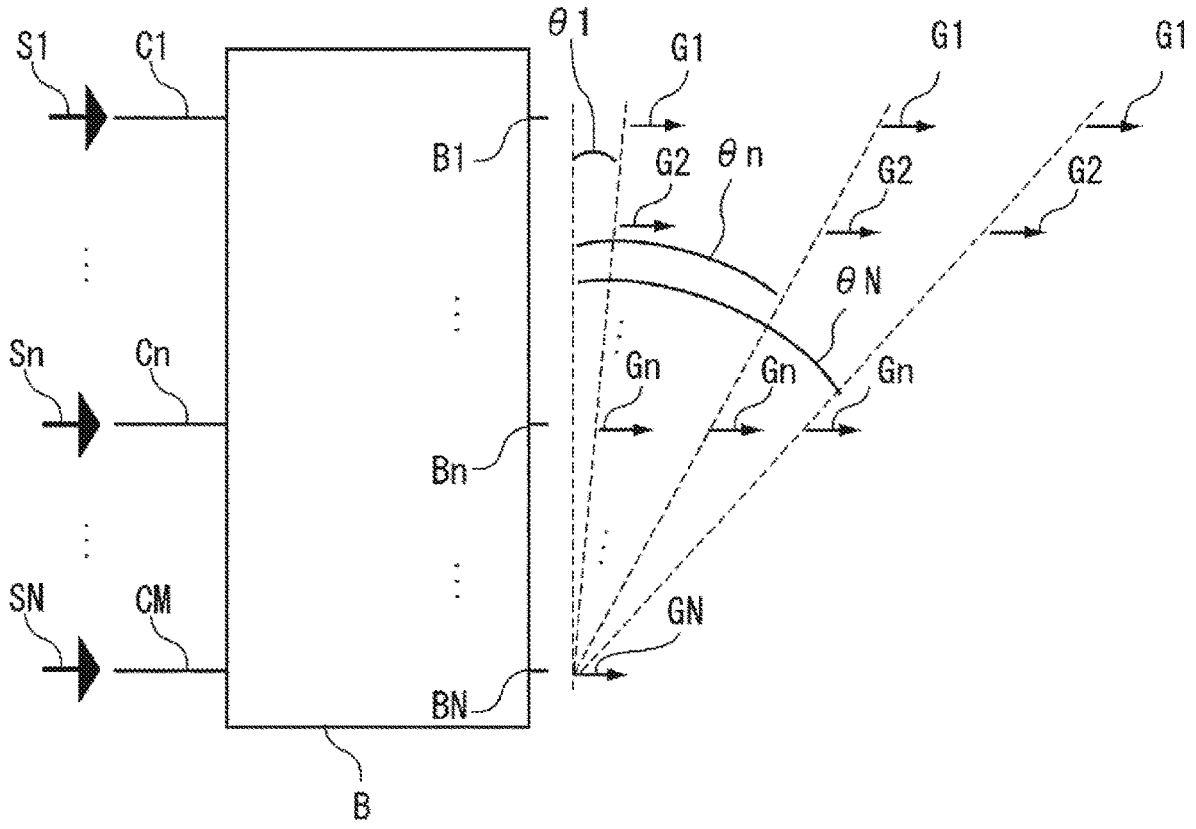
FIG. 13 is a diagram showing a state in which M different first signals are input to a radio transmitting antenna.

As shown in FIG. 13, when M different first signals S1 to SM are input to the M signal input ports C1 to CM, respectively, phase differences having different linear slopes θ1 to θN are given to the N second signals G1 to GN having equal power and corresponding to the signal input ports C1 to CM, and then the N second signals G1 to GN having equal power are output from the signal radiation ports B1 to BN, respectively. The second signals G1 to GN corresponding to the signal input ports C1 to CM are sequentially output from the antenna elements A1 to AN at equal intervals and at a predetermined time to thereby simultaneously form the M helical beams H1 to HM having different helical rotation pitches. That is, the radio transmitting antenna 10 can simultaneously multiplex and transmit the plurality of helical beams H1 to HM.

Figure 14:
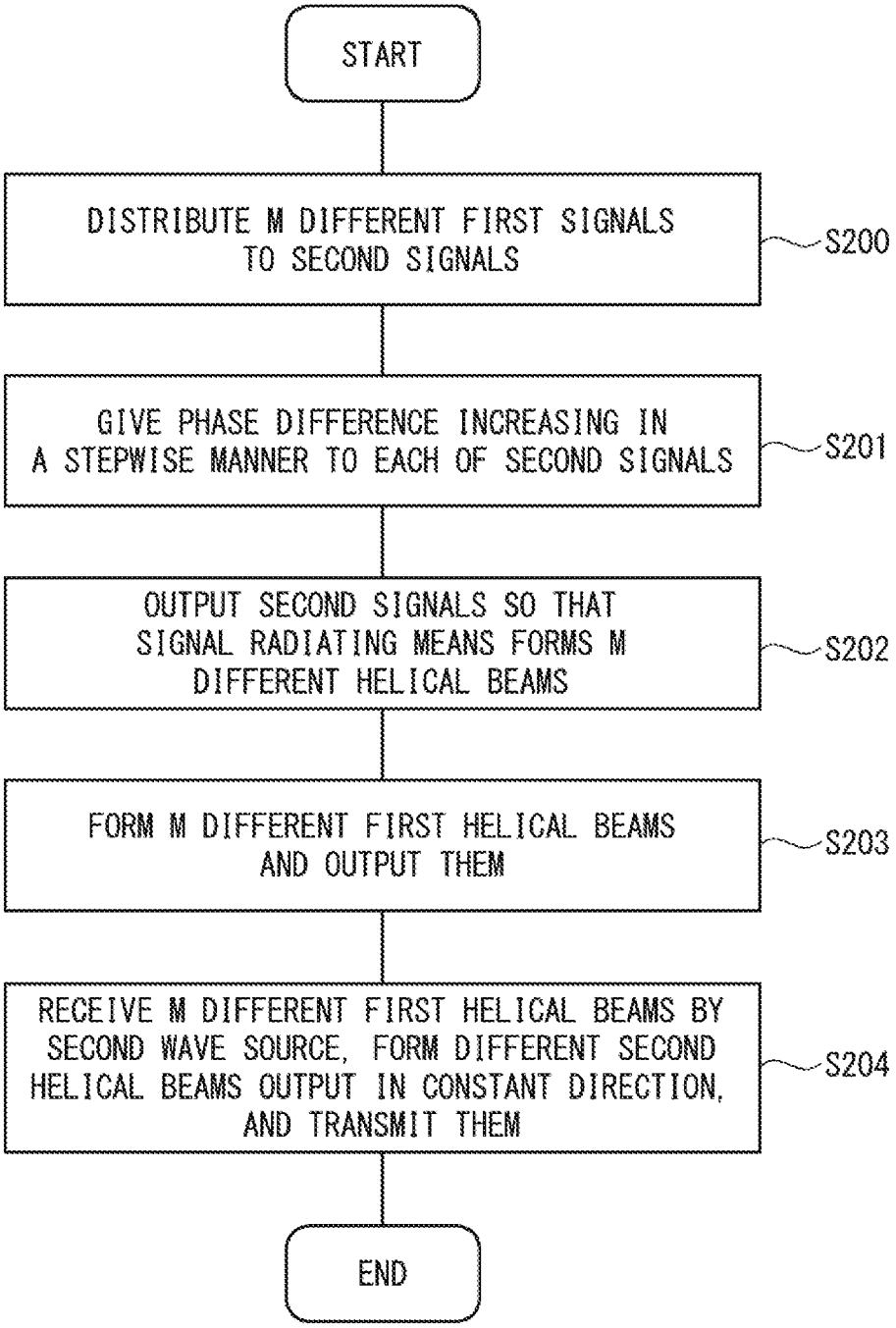
FIG. 14 is a flowchart showing a process of forming M different helical beams from a radio transmitting antenna.

Next, a radio transmitting method for forming a plurality of helical beams H having different helical rotation pitches performed by the radio transmitting antenna 10 will be described with reference to FIG. 14.

In the radio transmitting antenna 10, the signal distribution circuit B distributes the M different first signals S1 to SM input to the respective signal input ports C1 to CM into the N second signals G1 to GN having equal power and corresponding to the signal input ports C1 to CM and then outputs the N second signals G1 to GN (S200). The signal distribution circuit B gives different phase differences that increase in a stepwise manner to the N distributed second signals G1 to GN and outputs the N second signals G1 to GN from the signal radiation ports B1 to BN (S201).

The signal distribution circuit B distributes the second signals G1 to GN to the respective N antenna elements A1 to AN so that the M different helical beams H whose equiphase surfaces incline in a helical manner are formed from the signal radiating means A (S202). Then, the M different helical beams (the first helical beams) H are formed and output from the primary radiator 11 (the first wave source) (S203). The parabolic mirror part (the second wave source) 15 collects the M different helical beams H, forms the different M helical beams (the second helical beams) L output in the constant direction, and transmits the M helical beams L (S204).

As described above, the radio transmitting antenna 10 can simultaneously multiplex and transmit the plurality of helical beams H1 to HM.

Seventh Embodiment

An antenna having the same configuration as that of the above-described radio transmitting antennas 10, 60, 70, 80, 90 can also be used for receiving antennas of the radio transmitting antennas 10, 60, 70, 80, 90. The same combinations of the antennas may be used for the transmission and reception, or different combinations of the antennas may be used for the transmission and reception. The receiving antenna performs reception processing by performing a reverse operation of the processing performed by the transmitting antenna for transmitting the helical beam L. The radio receiving antenna 20 having the same configuration as that of the radio transmitting antenna 10 will be described as an example.

Figure 15:
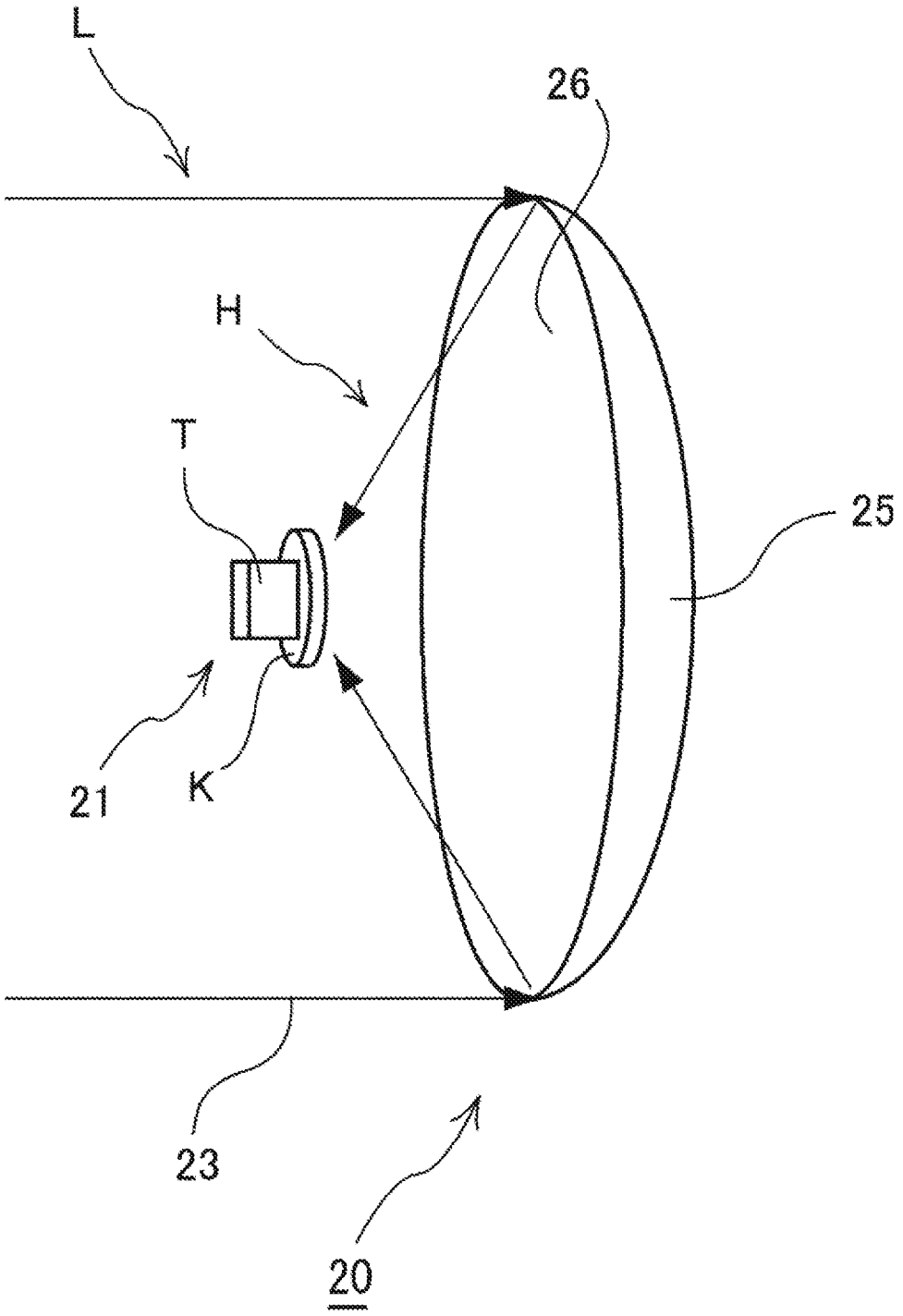
FIG. 15 is a diagram showing a configuration of a radio receiving antenna according to a seventh embodiment of the present invention.

As shown in FIG. 15, the radio receiving antenna 20 includes a parabolic mirror part 25 and first receiving means 21. The parabolic mirror part 25 is second receiving means for receiving a helical beam (the second helical beam) L for OAM (Orbital Angular Momentum) output in a constant direction and forms the helical beam (the first helical beam) H. The first receiving means 21 receives a helical beam H from the parabolic mirror part 25. That is, in the radio receiving antenna 20, the transmitted helical beam L is received and reflected by the parabolic mirror part unit 25. An outer diameter of the parabolic mirror part 25 may differ from an outer diameter of the parabolic mirror part 15 of the radio transmitting antenna 10. For example, the outer diameter of the parabolic mirror part 25 may be larger than the outer diameter of the parabolic mirror part 15 of the radio transmitting antenna 10.

The reflected helical beam L is formed into the helical beam (the first helical beam) H and output. The parabolic mirror part 25 receives the helical beam L and forms a helical beam (a third helical beam) H' having a third electromagnetic field distribution that is a reduced second electromagnetic field distribution of the helical beam L. The helical beam H' corresponds to the helical beam (the first helical beam) H formed by the primary radiator 11 of the radio transmitting antenna 10.

That is, the parabolic mirror part 25 receives the helical beam L and forms the helical beam H having the third electromagnetic field distribution concentrated in a small area near a focal point of the parabolic mirror part 25. Then, the helical beam H' is received by the first receiving means 21. The first receiving means 21 includes signal receiving means K, which is a reception unit for the helical beam H', and a signal combining circuit (signal combining means) T for combining signals received by the signal receiving means K. The first receiving means 21 has the same configuration as that of the primary radiator 11.

Figure 16:
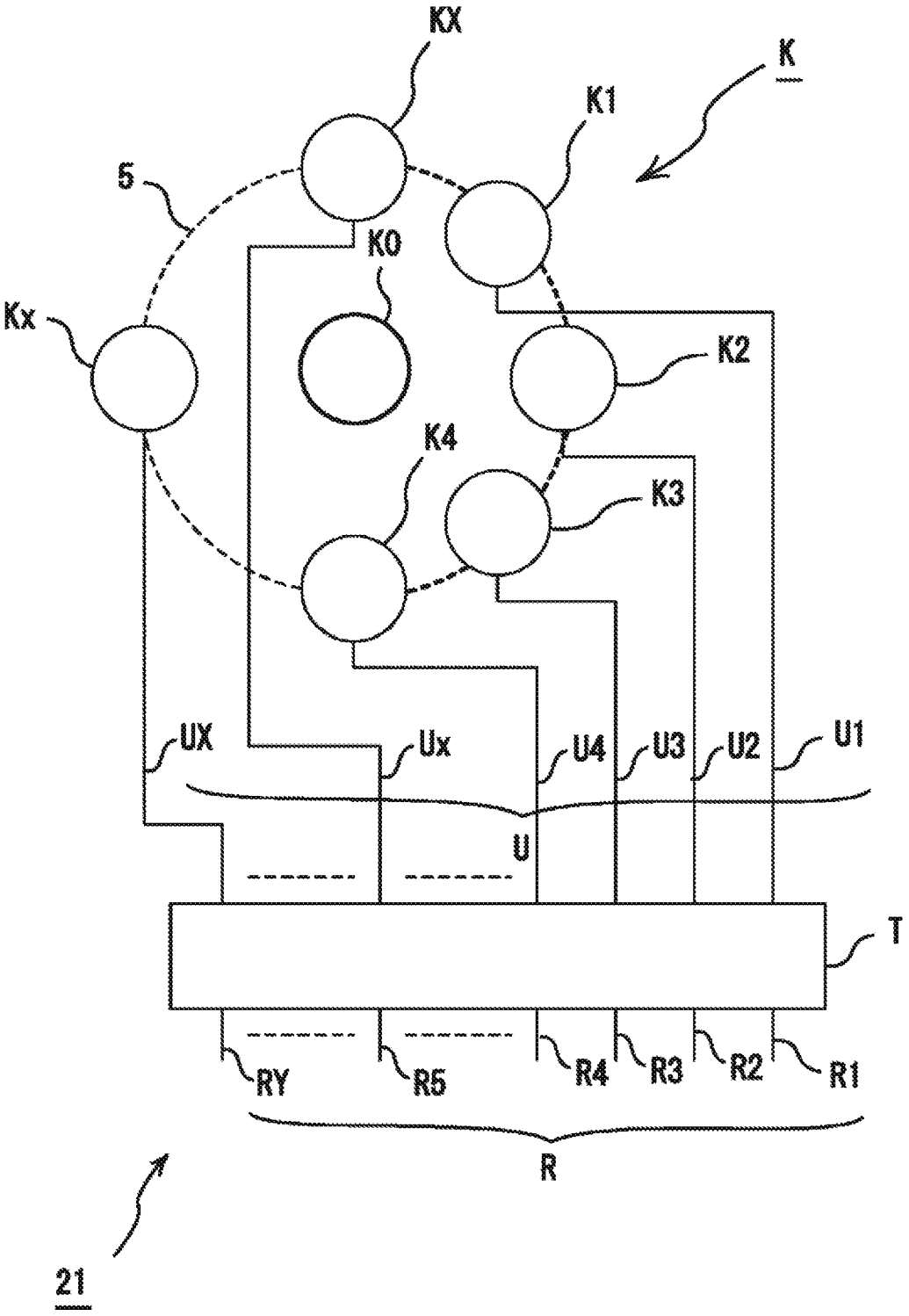
FIG. 16 is a block diagram showing a configuration of a primary radiator included in a radio transmitting antenna.

As shown in FIG. 16, the first receiving means 21 includes the signal receiving means K, the signal combining circuit (signal combining means) T, and signal output means R. The signal receiving means K includes X (X is an integer of two or greater) antenna elements K1 to KX evenly arranged on a circumference 3. The signal combining circuit T combines X second signals P1 to PX having equal power received from the respective antenna elements K1 to KX into a first signal Q. The signal output means R includes Y (positive integer $Y \leq X$) signal output ports R1 to RY that output the first signal Q. With such a configuration, the first receiving means 21 outputs the received helical beam H' as the first signal Q from the signal output ports R1 to RY. The number X of the antenna elements K1 to KX may be greater than the number N of the antenna elements A1 to AN of the primary radiator 11.

The antenna elements K1 to KX are evenly arranged on the circumference. The arranged plurality of antenna elements K1 to KX constitute the signal receiving means K. The same antenna element as the antenna element AN may be used as the antenna elements K1 to KX. The signal receiving means K and the signal combining circuit T are connected by a signal waveguide U. The signal waveguide U includes X equal length signal lines U1 to UX. The signal lines U1 to UX connect X signal input ports V1 to VX included in the signal combining circuit T to the antenna elements K1 to KX, respectively. Like the signal radiating means A, an antenna element K0 for receiving signals in a normal mode (non-OAM mode), which is not the OAM mode, may be provided at the center of the signal receiving means K. That is, the signal receiving means K may further include the antenna element K0 that receives signals in the non-OAM mode.

A coaxial cable or a waveguide can be used as the signal lines U1 to UX. Like the plurality of antenna elements A1 to AN, the antenna elements K1 to KX may be arranged evenly on a circumference concentric with a circumference 5 in addition to the ones arranged on the circumference 3 (see FIGS. 10A to 10D). In the first receiving means 21, a diameter of the circumference 5 may differ from a diameter of the circumference 3 in the primary radiator 11.

The signal combining circuit T combines the second signals P1 to PX having equal power input from the plurality of signal input ports V1 to VX and outputs the combined signal from any one of the signal output ports R1 to RY as the first signal Q according to the helical rotation pitch included in the helical beam H'. For example, a Butler matrix feeder circuit can be used as the signal combining circuit T. The signal combining circuit T has the same configuration as that of the signal distribution circuit B included in the primary radiator 11 (see FIG. 12).

That is, when the second signals P1 to PX are input to the signal distribution circuit B conversely, the signals are combined into the first signal Q and then output, and the signal distribution circuit B becomes the signal combining circuit T. In other words, the radio receiving antenna 20 can output the helical beam H' as the first signal Q by a reverse operation of the operation of the radio transmitting antenna 10.

Specifically, the signal combining circuit T receives the helical beam whose equiphase surface inclines in a helical manner, which has been received by the signal receiving means K including X antenna elements K1 to KX arranged at equal intervals on the circumference 5, as the X second signals P1 to PX from the N respective antenna elements K1 to KX, gives a phase difference to each of the X second signals P1 to PX, combines the X second signals P1 to PX, and outputs the first signal Q. Then, the signal combining circuit T gives a predetermined phase difference that decreases in a stepwise manner in the circumferential direction to the X second signals P1 to PX input from the adjacent antenna elements arranged in the signal receiving means K.

In the above description, an example using a Butler matrix feeder circuit for the signal combining circuit T has been described. However, any element may be used as the signal combining circuit T as long as it can receive the helical beam H' from each of the antenna elements K1 to KX arranged at equal intervals on the circumference and output the signal Q. Moreover, the phase differences given to the second signals P1 to PX are not necessarily equally spaced intervals.

Figure 17:
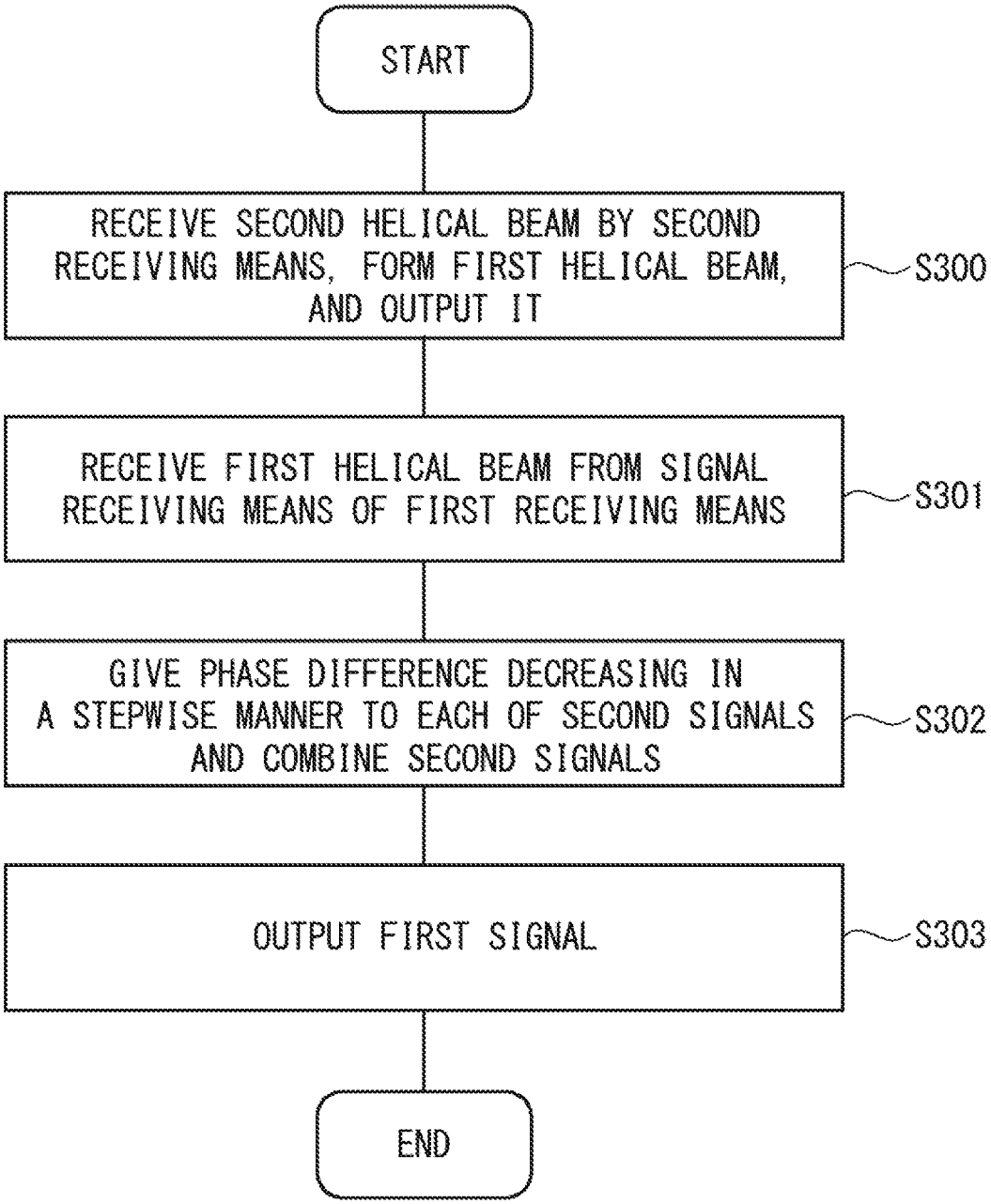
FIG. 17 is a flowchart showing a process in which a radio receiving antenna receives a helical beam.

Next, processing in which the radio receiving antenna 20 receives the helical beam L will be described with reference to FIG. 17.

When the helical beam L is transmitted from the radio transmitting antenna 10, the radio receiving antenna 20 receives the helical beam L by the parabolic mirror surface part 25, which is the second receiving means, forms the helical beam (the first helical beam) H', and outputs the helical beam H' (300). The first receiving means 21 sequentially receives the second signals P1 to PX in the fixed rotation direction from the respective X antenna elements K1 to KX evenly arranged on the circumference 5 (S301).

As the phase difference increasing in a stepwise manner is given to the second signals P1 to PX, conversely, the signal combining circuit T gives the phase difference decreasing in a stepwise manner to each of the second signals P1 to PX and combines the second signals P1 to PX (S302). The signal combining circuit T outputs the first signal Q from any one of the signal output ports R1 to RY (S303).

As described above, the radio receiving antenna 20 can output the received helical beam L as the first signal Q. In this way, in the first receiving means 21, the distance between the antenna elements K1 to KX is narrowed, and the device can be downsized to the level of a wavelength. In order to enhance the reception sensitivity of the helical beam L transmitted from the radio transmitting antenna 10, the diameter of the parabolic mirror part 25 may be increased, and it is not necessary to increase the size of the device configuration of the first receiving means 21.

For example, the ring array antenna described in Patent Literature 1 can receive only signals of a specific mode defined by the diameter of the ring array, whereas the radio receiving antenna 20 can receive all signals of the modes less than or equal to an aperture diameter of the parabolic mirror part 25. Further, the ring array antenna described in Patent Literature 1 can receive signals at a specific distance, whereas the radio receiving antenna 20 can receive signals anywhere as long as the distance is equal to or less than a maximum distance determined by the aperture diameter. Furthermore, the radio receiving antenna 20 receives signals on the surface of the parabolic mirror part 25, and thus it can efficiently receive signals of a plurality of modes having different energy distributions.

Therefore, the radio receiving antenna 20 can enhance the reception sensitivity of the helical beam L with a simplified device configuration. This also applies to the case when an antenna having the same configuration as that of the radio transmitting antennas 60, 70, 80, and 90 is used as the reception antenna.

Eighth Embodiment

The radio receiving antenna 20 can receive Y helical beams H having different helical rotation pitches multiplexed and transmitted by the radio transmitting antenna 10 in the second embodiment and outputs them as Y first signals Q. In the following description, the same elements as those of other embodiments are denoted by the same reference terms and signs, and repeated descriptions will be omitted as appropriate.

Figure 18:
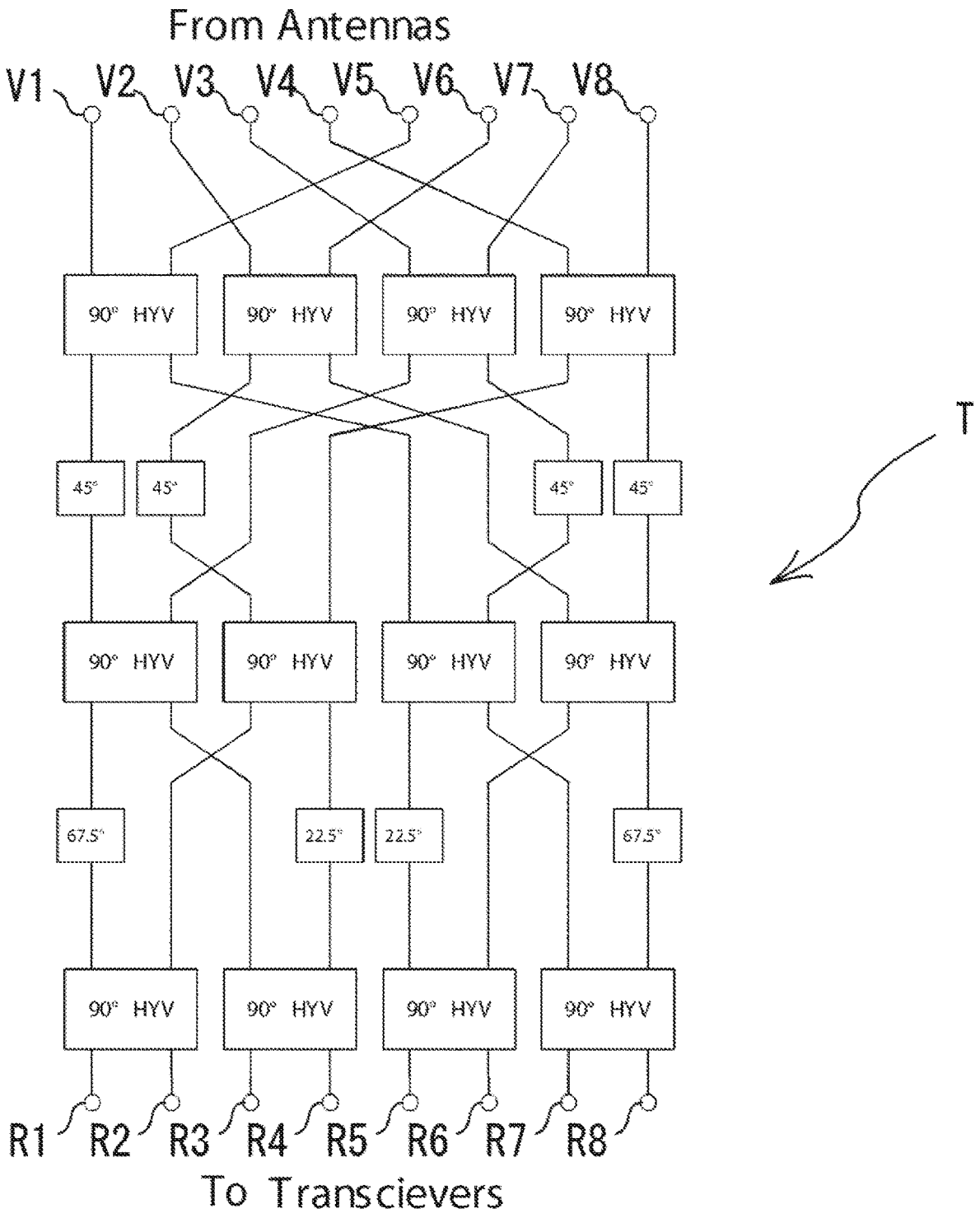
FIG. 18 is a diagram showing a configuration of a signal combining circuit included in a radio receiving antenna.

As shown in FIG. 18, in the radio receiving antenna 20, the first receiving means 21 includes a signal combining circuit T. The signal combining circuit T includes a plurality of signal input ports V1 to VX and a plurality of signal output ports R1 to RY. In FIG. 18, a configuration of the signal combining circuit T including a Butler matrix feeder circuit of Y=8 and X=8 is shown. The signal combining circuit T has the same configuration as that of the signal distribution circuit B of the second embodiment. That is, when the signal combining circuit T receives the Y helical beams having different helical rotation pitches through the reverse operation of the operation of the signal distribution circuit B, the signal combining circuit T gives the linear phase difference having a slope opposite to the slope corresponding to the signal output ports R1 to RY to each of the received X second signals P1 to PX, combines the second signals P1 to PX, and outputs the Y first signals Q from the signal output ports R1 to RY, respectively.

Figure 19:
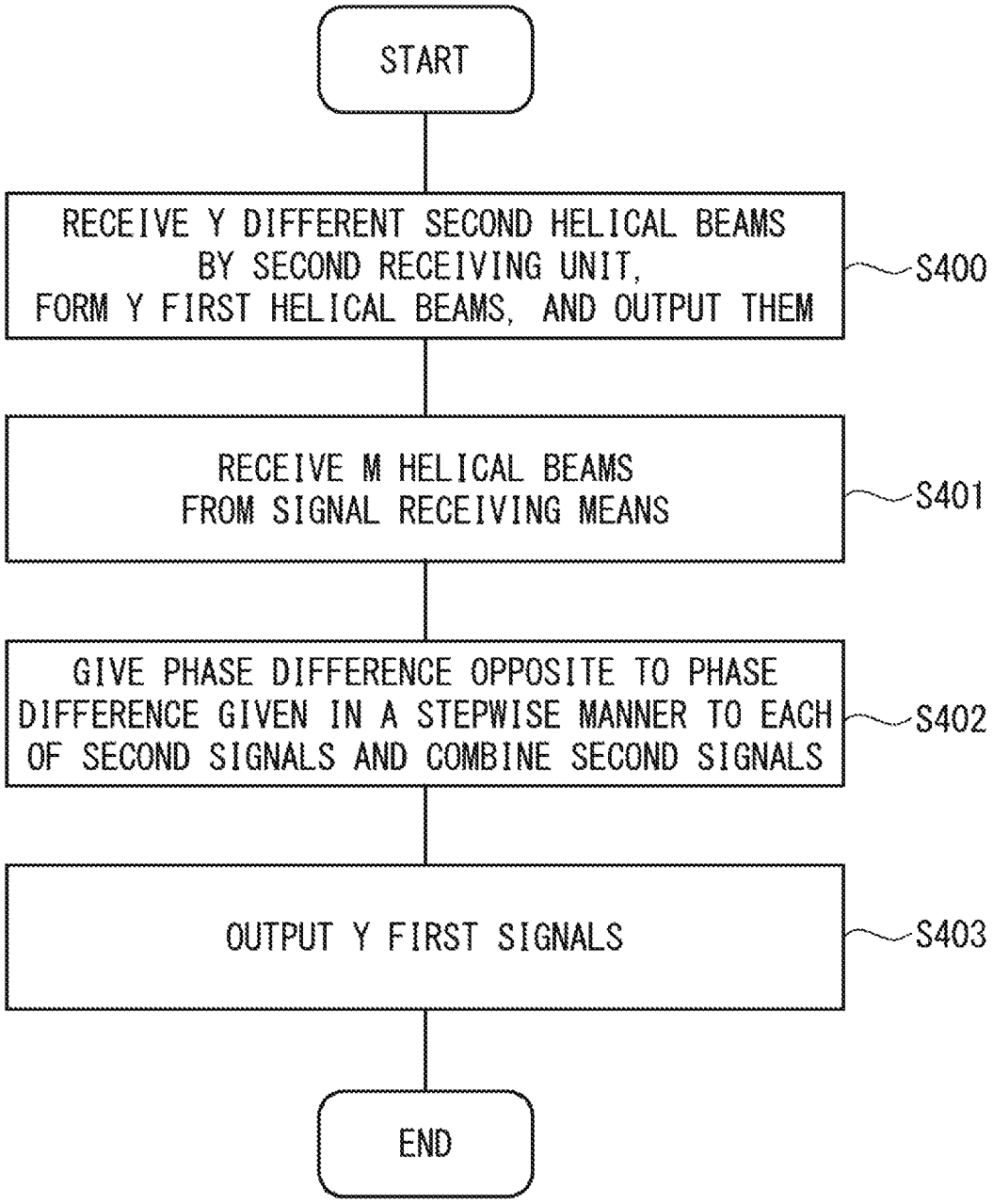
FIG. 19 is a flowchart showing a process in which the radio receiving antenna receives M different helical beams.

Next, processing in which the radio receiving antenna 20 receives signals including Y helical beams H having different helical rotation pitches will be described with reference to FIG. 19.

When the Y helical beams L having different helical rotation pitches are transmitted from the radio transmitting antenna 10, the radio receiving antenna 20 receives the Y different helical beams (the second helical beams) L by the parabolic mirror part (a second receiving unit) 25, forms the Y helical beams (the first helical beams) H, and outputs them (S400). The first receiving means 21 receives the second signals P1 to PX from the X antenna elements K1 to KX evenly arranged on the circumference in a fixed rotation direction (S401). As the phase difference increasing in a stepwise manner is given to the second signals P1 to PX, conversely to the phase difference increasing in a stepwise manner, the signal combining circuit T gives the phase difference decreasing in a stepwise manner to each of the second signals P1 to PX and combines the second signals P1 to PX (S402). The signal combining circuit T outputs the Y different first signals Q from the signal output ports R1 to RY (S403).

As described above, the radio receiving antenna 20 can receive the Y helical beams L having different helical rotation pitches multiplexed and transmitted by the radio transmitting antenna 10 and outputs them as the Y first signals Q.

Ninth Embodiment

The above-described radio transmitting antenna 10 and the radio receiving antenna 20 can constitute a radio transceiver system 100 that performs radio transmission and reception using the helical beam L. Any one of the radio transmitting antennas 10, 60, 70, 80, 90 may be used for the transmission. An antenna having the same configuration as that of the radio transmitting antennas 10, 60, 70, 80, and 90 can also be used as the reception antenna. The same combinations of the antennas may be used for the transmission and reception, or different combinations of the antennas may be used for the transmission and reception.

Figure 20:
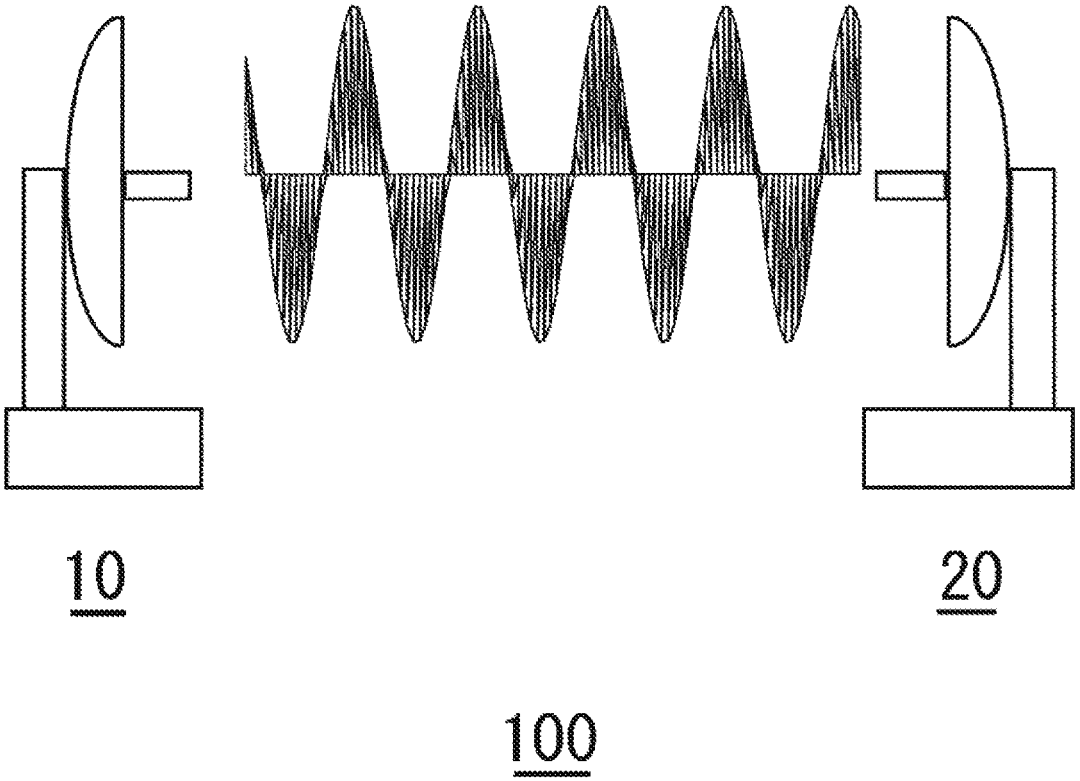
FIG. 20 is a diagram showing a configuration of a radio transceiver system according to an eighth embodiment of the present invention.

As shown in FIG. 20, the radio transceiver system 100 includes the radio transmitting antenna 10 and the radio receiving antenna 20. The radio transceiver system 100 can transmit and receive signals including the Y helical beams H having multiplexed different helical rotation pitches.

Tenth Embodiment

Figure 21:
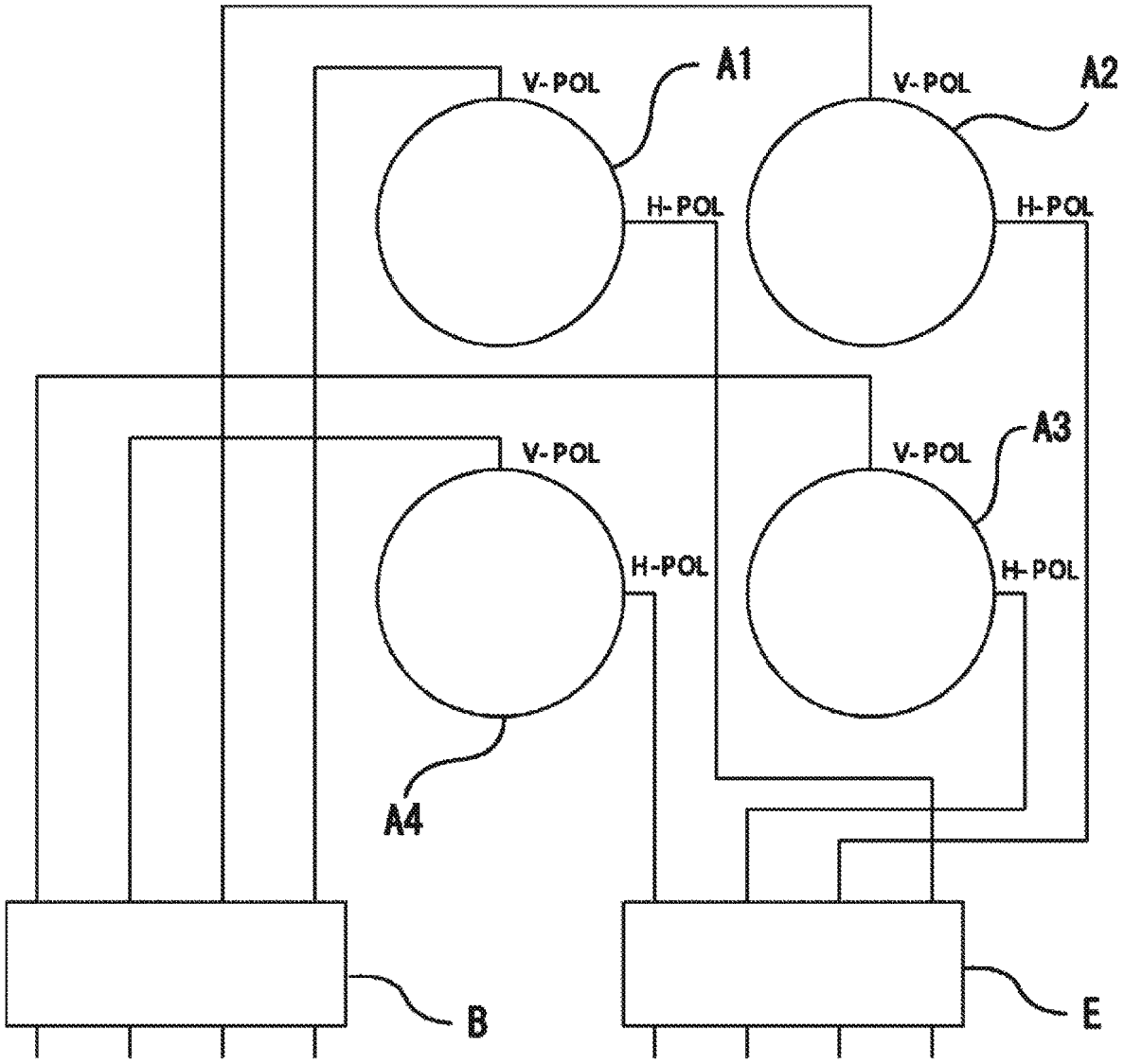
FIG. 21 is a block diagram showing a configuration of a primary radiator according to a tenth embodiment of the present invention.

FIG. 21 shows a primary radiator 31, which is a modified example of the primary radiator 11. The primary radiator 31 includes M additional signal input ports Z1 to ZN and another signal distribution circuit E. To the M signal input ports Z1 to ZN, M different first signals W orthogonal to first signals S for forming a helical beam J, which is an orthogonal polarization of the helical beam H transmitted by the radio transmission antenna 10, are input. The signal distribution circuit E receives the first signals W and outputs N second signals F1 to FN that are orthogonal to second signals G1 to GN.

Thus, a radio transmitting antenna 30 can transmit a helical beam I having a VH polarization. A radio receiving antenna (not shown) having the same configuration as that of the radio transmitting antenna 30 can receive the helical beam I having the VH polarization and output the M first signals and other M first signals.

In the above embodiments, the present invention has been described as a hardware configuration, but the present invention is not limited to this. The present invention can also be realized by performing predetermined processing by DSP (Digital Signal Processing), by executing a program on a DSP (Digital Signal Processor), or by executing a program by a logical circuit composed on an FPGA (Field Programmable Gate Array) or an ASIC (Application Specific Integrated Circuit).

The program can be stored and provided to a computer using any type of non-transitory computer readable media. Non-transitory computer readable media include any type of tangible storage media. Examples of non-transitory computer readable media include magnetic storage media (such as floppy disks, magnetic tapes, hard disk drives, etc.), optical magnetic storage media (e.g., magneto-optical disks), CD-ROM (Read Only Memory), CD-R, CD-R/W, and semiconductor memories (such as mask ROM, PROM (Programmable ROM), EPROM (Erasable PROM), flash ROM, RAM (Random Access Memory), etc. The program may be provided to a computer using any type of transitory computer readable media. Examples of transitory computer readable media include electric signals, optical signals, and electromagnetic waves. Transitory computer readable media can provide the program to a computer via a wired communication line (e.g., electric wires, and optical fibers) or a wireless communication line.

Figure 22:
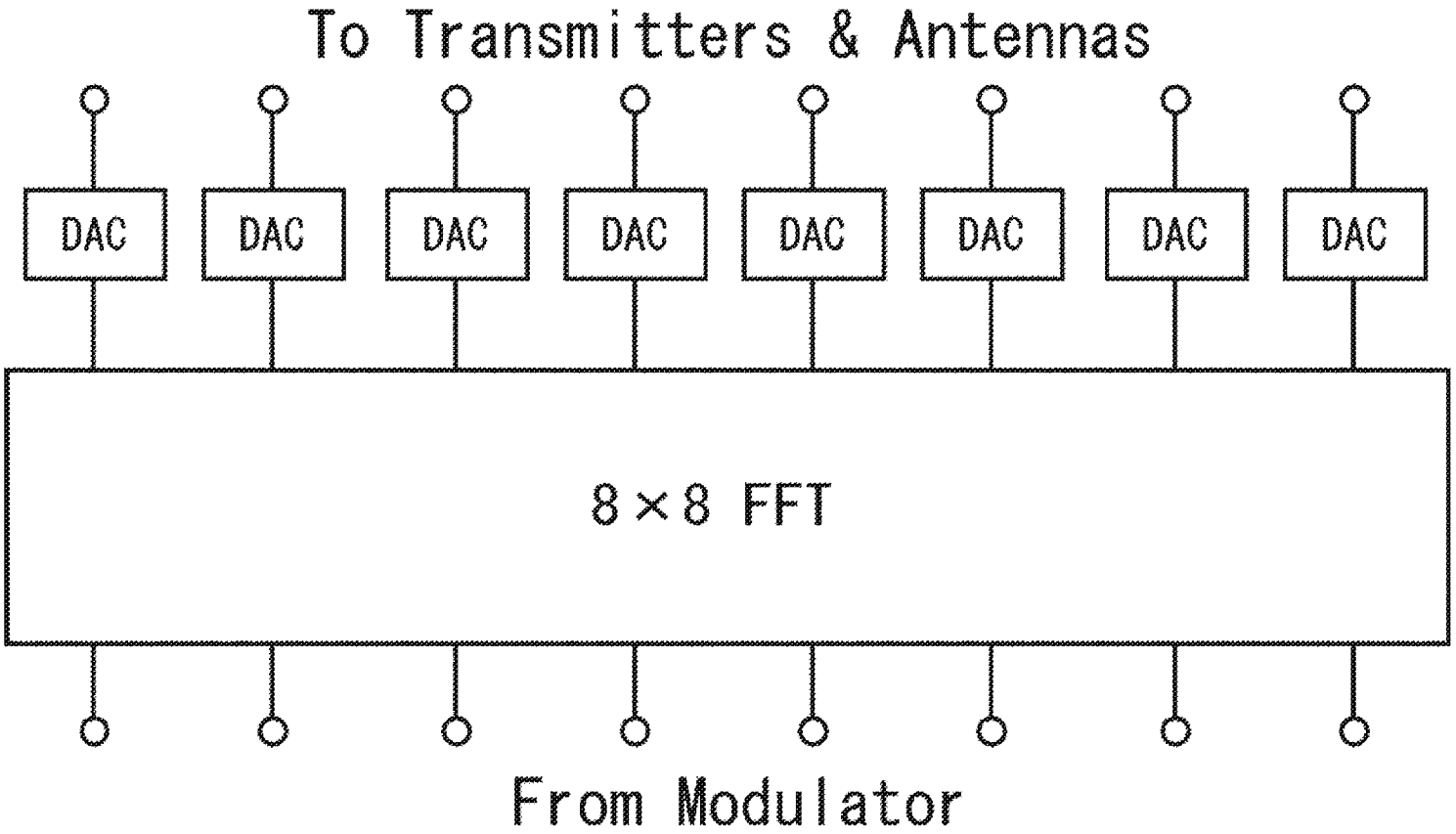
FIG. 22 shows a modified example using an FFT circuit for a signal distribution circuit.
Figure 23:
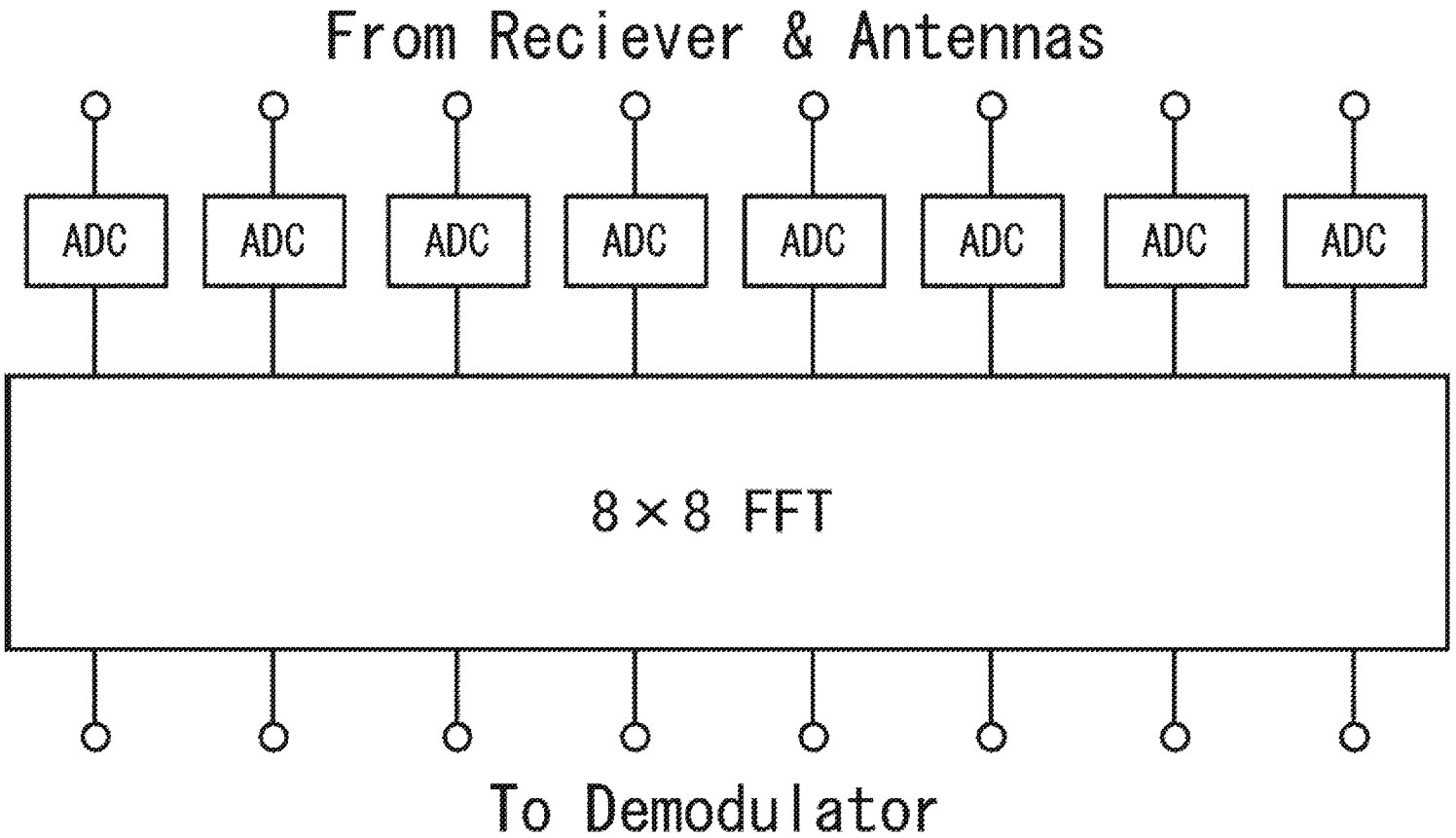
FIG. 23 shows a modified example using an FFT circuit for a signal combining circuit.

Although the present invention has been described with reference to the embodiments, the present invention is not limited by the above description. Various changes that can be understood by those skilled in the art within the scope of the invention can be made to the configurations and details of the present invention. For example, an 8×8 FFT (Fast Fourier Transform) circuit may be used as the signal distribution circuit B and the signal combining circuit T when digital demultiplexing or demodulating modes with BB (see FIGS. 22 and 23).

REFERENCE SIGNS LIST

10, 60, 70, 80, 90 RADIO TRANSMITTING ANTENNA
11 PRIMARY RADIATOR
15 PARABOLIC MIRROR PART
16 PARABOLIC SURFACE
20 RADIO RECEIVING ANTENNA
21 RECEIVING MEANS
25 PARABOLIC MIRROR PART
30 RADIO TRANSMITTING ANTENNA
31 PRIMARY RADIATOR
63 SUB-REFLECTING MIRROR PART
63B SUB-REFLECTING MIRROR PART
64 HYPERBOLOID SURFACE
64B ROTATION ELLIPSOID SURFACE
65 PARABOLIC MIRROR PART
66 PARABOLIC SURFACE
85 PARABOLIC MIRROR PART
86 PARABOLIC SURFACE
95 LENS SURFACE PART
100 RADIO TRANSCEIVER SYSTEM
A SIGNAL RADIATING MEANS
A0 TO AN ANTENNA ELEMENT
AN ANTENNA ELEMENT
B SIGNAL DISTRIBUTION CIRCUIT
B1 TO BN SIGNAL RADIATION PORT
C1 TO CM SIGNAL INPUT PORT
D SIGNAL WAVEGUIDE
D1 TO DN SIGNAL LINE
E SIGNAL DISTRIBUTION CIRCUIT
F1 TO FN SIGNAL
G1 TO GN SIGNAL
H HELICAL BEAM
H' HELICAL BEAM
H1 TO HM HELICAL BEAM
I HELICAL BEAM
J HELICAL BEAM
K SIGNAL RECEIVING MEANS
K0 TO KX ANTENNA ELEMENT
L HELICAL BEAM
P1 TO PX SIGNAL
Q SIGNAL
R SIGNAL OUTPUT MEANS
R1 TO RY SIGNAL OUTPUT PORT
S SIGNAL
S1 TO SM SIGNAL
T SIGNAL COMBINING CIRCUIT
U SIGNAL WAVEGUIDE

U1 TO UX SIGNAL LINE
V1 TO VX SIGNAL INPUT PORT
W SIGNAL
Z1 TO ZN SIGNAL INPUT PORT

What is claimed is:

1. A radio signal transmitting antenna comprising:

a first wave source including a plurality of antenna elements configured to form a first helical beam for OAM (Orbital Angular Momentum) from the plurality of antenna elements and output the first helical beam; and a second wave source configured to receive the first helical beam and form a second helical beam including a second electromagnetic field distribution, the second electromagnetic field distribution being an expanded first electromagnetic field distribution included in the first helical beam, wherein the first wave source comprises:

the N (integer N≥2) antenna elements arranged at equal intervals on a concentric circumference; and a signal distribution circuit for generating, from an input first signal, N second signals having a phase difference from one another and outputting the N second signals having the phase difference from one another to the N antenna elements so that the first helical beam whose equiphase surface inclines in a helical manner is output from the N antenna elements, and wherein when M (integer M≤N) different first signals are input, the signal distribution circuit distributes the second signals to the respective N antenna elements so that M different helical beams are output from the N antenna elements.

2. The radio signal transmitting antenna according to claim 1, wherein the second wave source comprises a first reflecting unit including a parabolic mirror part that reflects the first helical beam and forms the second helical beam.

3. The radio signal transmitting antenna according to claim 2, wherein the second wave source further comprises a second reflecting unit including a sub-reflecting mirror part that makes the first helical beam output from the first wave source be indirectly reflected on the first reflecting unit.

4. The radio signal transmitting antenna according to claim 1, wherein the second wave source comprises a third another reflecting unit including a lens surface part that refracts the first helical beam to form the second helical beam.

5. The radio signal transmitting antenna according to claim 2, wherein the signal distribution circuit distributes a signal so that the second signals including a predetermined phase difference that increases in a stepwise manner in a direction of the circumference are input to the adjacent antenna elements.

6. The radio signal transmitting antenna according to claim 2, further comprising another signal distribution circuit for receiving M different other first signals orthogonal to the first signals and outputting N other second signals orthogonal to the second signals in such a way that an orthogonal polarization of the first helical beam is formed from the N antenna elements.

7. The radio signal transmitting antenna according to claim 1, wherein the first wave source further comprises an antenna element that outputs a signal in a non-OAM mode.

* * * * *